US007943281B2

(12) United States Patent
Kaya et al.

(10) Patent No.: US 7,943,281 B2
(45) Date of Patent: May 17, 2011

(54) BLACK TONER

(75) Inventors: Takaaki Kaya, Mishima (JP); Yasukazu Ayaki, Yokohama (JP); Shigeto Tamura, Suntoh-gun (JP); Yayoi Tazawa, Mishima (JP); Ryoichi Fujita, Tokyo (JP); Yuichi Yajima, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 11/576,420

(22) PCT Filed: Apr. 14, 2006

(86) PCT No.: PCT/JP2006/308374

§ 371 (c)(1),
(2), (4) Date: Mar. 30, 2007

(87) PCT Pub. No.: WO2006/112518

PCT Pub. Date: Oct. 26, 2006

(65) Prior Publication Data

US 2009/0011353 A1 Jan. 8, 2009

(30) Foreign Application Priority Data

Apr. 15, 2005 (JP) ..... 2005-117739

(51) Int. Cl.
*G03G 9/09* (2006.01)

(52) U.S. Cl. ..... 430/108.4; 430/108.6

(58) Field of Classification Search ..... 430/108.4, 430/108.6, 106.2

See application file for complete search history.

(56) References Cited

U.S. PATENT DOCUMENTS

| | | | | |
|---|---|---|---|---|
| 5,199,983 | A | 4/1993 | Katamoto | |
| 5,741,617 | A * | 4/1998 | Inaba et al. | 430/108.4 |
| 6,080,519 | A * | 6/2000 | Ishiyama et al. | 430/110.3 |
| 6,326,113 | B1 * | 12/2001 | Okuda et al. | 430/108.21 |
| 6,844,067 | B2 * | 1/2005 | Shimo et al. | 428/402 |
| 7,163,774 | B2 | 1/2007 | Shiraishi et al. | |
| 7,217,485 | B2 | 5/2007 | Hasegawa et al. | |
| 7,327,974 | B2 | 2/2008 | Yaguchi et al. | |
| 2004/0053153 | A1 | 3/2004 | Yaguchi et al. | |
| 2004/0157147 | A1 | 8/2004 | Shiraishi et al. | 430/109.4 |
| 2004/0234879 | A1 | 11/2004 | Hasegawa et al. | 430/108.3 |

FOREIGN PATENT DOCUMENTS

| | | | |
|---|---|---|---|
| EP | 1 343 053 | A1 | 9/2003 |
| EP | 1 505 452 | A2 | 2/2005 |
| EP | 1 207 433 | A2 | 5/2005 |
| JP | 3002276 | | 1/1991 |
| JP | 3220566 | | 9/1991 |
| JP | 2002196528 | | 7/2002 |
| JP | 2002221821 | | 8/2002 |
| JP | 2004054094 | | 2/2004 |
| JP | 2004102154 | | 4/2004 |
| JP | 2004161608 | | 6/2004 |
| JP | 2005-200285 | * | 7/2005 |

OTHER PUBLICATIONS

Japanese Patent Office machine-assisted translation of JP 2005-200285 (pub. Jul. 2005).*

* cited by examiner

*Primary Examiner* — Janis L Dote

(74) *Attorney, Agent, or Firm* — Fitzpatrick, Cella, Harper & Scinto

(57) ABSTRACT

In a black toner having at least a binder resin and an iron-titanium composite oxide as a colorant; the iron-titanium composite oxide is contained in a specific amount; the black toner has a specific weight average particle diameter and a specific saturation magnetization; the black toner has, in X-ray diffraction thereof, a maximum peak at 2θ=from 32.5 to 33.1 degrees, having a half width of 0.25 degree or less. The black toner has, in a proportion of less than 30% by number, an iron-titanium composite oxide having, in a sectional photograph of the toner, a maximum frequency of linearity within the range where the linearity is smaller than 2.4 and having a linearity of 3.0 or more, in regard to the number frequency distribution of the linearity of the iron-titanium composite oxide.

11 Claims, 1 Drawing Sheet

BLACK TONER

TECHNICAL FIELD

This invention relates to a toner used in a recording process which utilizes electrophotography, electrostatic recording, magnetic recording or toner jet recording.

BACKGROUND ART

A number of methods are conventionally known as methods for electrophotography. In general, fixed images are obtained by uniformly electrostatically charging by, e.g., corona charging or by direct charging using a charging roller the surface of a latent image bearing member comprising a photoconductive material, forming an electrostatic latent image on the latent image bearing member by its irradiation with light energy, subsequently developing this electrostatic latent image by the use of a toner standing charged positively or negatively, to form a toner image, and transferring the toner image to a transfer material such as paper as occasion calls, and thereafter fixing the toner image to the transfer material by the action of heat and/or pressure. The toner that has not been transferred to and has remained on the photosensitive member at the time of transfer is removed by various means, and then the above process is repeated.

Developing systems by which this electrostatic latent image is rendered visible include a dry-process developing method and a wet-process developing method as classified roughly. The dry-process developing method is divided into a method making use of a two-component developer constituted of a toner and a carrier, and a one-component developer constituted of only a toner.

In recent years, in image forming apparatus which employs electrophotography, such as printers or copying machines, they are required to form images having a higher resolution, in circumstances where they are variously demanded to be made compact and light-weight, high-speed and high-productivity, energy savable, highly reliable, low-cost, maintenance-free and so forth. In particular, images formed by using a black toner are required to be very minutely and faithfully reproduced up to full details in not only black and white image forming apparatus but also color image forming apparatus. Accordingly, as toners, they are required to be more improved in developing stability and charging stability.

As toners used in these image forming apparatus, they are commonly prepared by forming toner particles (toner base particles) comprising a thermoplastic resin and dispersed therein a colorant such as a dye or a pigment, a wax as a release agent, a charge control agent and so forth, and optionally making inorganic fine particles such as fine silica particles adhere or stick to the surfaces of the toner particles.

As colorants used in the black toner, black pigment particles such as carbon black and magnetite particles are used. The carbon black is relatively inexpensive and has a good blackness, but, because of its conductivity, the black toner tends to have low developing stability and charging stability. Also, when used in full-color image forming apparatus, because of the conductivity of the carbon black, the black toner causes image deterioration because of its difference in transfer performance from other color toners such as a cyan toner, a magenta toner and a yellow toner.

As for the magnetite particles, they are commonly used as a magnetic material of a magnetic toner used in a magnetic one-component developing system. Compared with the carbon black, the magnetite particles have a relatively large resistivity and can achieve relatively good developing stability and charging stability, but still have what are to be improved in their resistivity and coloring power. Especially where images are formed by a full-color system, the magnetite particles can not readily show electrostatically the same behaviour as pigments used in color toners do, because of the former's lower resistivity than the latter.

The magnetic toner also commonly contains the magnetite particles in a large quantity in order to attain a sufficient magnetic binding force. Hence, it is difficult for the toner to be improved in low-temperature fixing performance. Especially when used in full-color image forming apparatus, the fixing performance may come to differ between the magnetic toner and other color toners such as a cyan toner, a magenta toner and a yellow toner, so that the gloss of images tends to be non-uniform.

Moreover, the magnetic toner used in a magnetic one-component developing system promises stable development, but still has an insufficient charging performance. Accordingly, when, e.g., used in combination with color toners of non-magnetic two-component developing systems, image deterioration due to the difference in transfer performance tends to come about because of the difference in charging performance like the case in which the carbon black is used. Also, where the magnetic toner is used in the two-component developing method, the magnetic toner, though improved in charging performance, tends to adhere magnetically to a developer carrying member such as a developing roller, tending to cause image deterioration during running.

In order to resolve these problems, toners are proposed which make use of a non-magnetic or weakly magnetic black pigment (e.g., Japanese Patent Applications Laid-open No. 2002-221821, No. 2004-102154, No. H03-220566 and No. 2004-054094). These toners have a small saturation magnetization, and are also usable in the two-component developing system. However, according to studies made by the present inventors, these toners have black pigment particles having an insufficient blackness, and hence it has been found unable to represent black characters or letters and fine lines having a sufficiently high reflection density and a high quality level. Also where the black pigment itself has a sufficient blackness to a certain degree, there have been a problem that no sufficient image density is achievable when the black toner is used alone and a problem that dark-red images are formed, if the black pigment is dispersed in a binder resin.

A proposal is also made on a toner which contains a low-magnetized metal oxide and has prescribed the color of fixed images (Japanese Patent Application Laid-open No. 2002-196528). However, the metal oxide in the above has a reddish black color, and has substantially been not usable in black toners unless a blue pigment is used in combination. A proposal is also made in regard to iron-titanium composite oxide (e.g., Japanese Patent Application Laid-open No. H03-002276). There, however, has been a problem that, when the composite oxide is low-magnetized, image density is achievable to a certain extent at solid image areas but images are reddish at halftone areas. A black pigment powder is also presented which makes use of iron-titanium composite oxide and has a saturation magnetization of from 5 to 40 $Am^2/kg$ (e.g., Japanese Patent Application Laid-open No. 20004-161608. However, a problem has tended to arise during running when a black toner containing such a black pigment powder is used to perform two-component development or used in combination with color toners to form full-color images.

DISCLOSURE OF THE INVENTION

As stated above, although the non-magnetic or weakly magnetic black pigment has been proposed, any black colorant has not been available which can well achieve both i) the properties required as a black colorant, such as properties "to improve coloring power", "to improve blackness" and "to have a low saturation magnetization" and ii) the performance required when made into a toner, such as developing performance, transfer performance and fixing performance.

Where a colorant has a low coloring power, the problem may be solved by using the colorant in a toner in a larger quantity or by using the toner in a larger laid-on level. However, the use of the colorant in a larger quantity tends to result in a low fixing performance, or may cause a change in electrical behavior in the development or transfer because of an increase in specific gravity, to tend to cause defects such as non-uniform images and blank images. In particular, image defects tend to come into question when used in a full-color electrophotographic process. Also, the use of the toner in a larger laid-on level similarly makes development and transfer difficult, and further tends to cause a problem also in fixing.

Hence, it is necessary to use a black colorant having a large coloring power and a high blackness, and further it is necessary for a black toner to be improved in dispersibility of such a colorant and have a higher coloring power.

In forming full-color images, a problem also tends to arise such that images come coarse only at black background areas. What is given as the cause of such coarse images is the difference in gloss between the color toners and the black toner.

In regard to how to eliminate the difference in gloss between color toners and black toner, the molecular weight of a binder resin of the black toner may be controlled and further the types of monomers constituting the binder resin may be changed, to control its viscoelastic properties and melting point to uniform the gloss at solid areas at least. It, however, has been difficult to keep images from coming coarse at black halftone areas. This is considered due to the fact that, when halftone images are formed, the transfer performance and the fixing performance deviate between the black toner and the color toners even if these properties are so controlled that the gloss may come uniform at solid areas. Hence, it has been very difficult in the above measures to keep black background areas from coming coarse at both the solid areas and the halftone areas.

An object of the present invention is to provide a black toner which has resolved the above problems, can achieve a high resolution and has a superior fine-line reproducibility and superior charging stabilizing performance and running stabilizing performance.

Another object of the present invention is to provide a black toner which enables formation of high-quality black images having been kept from graininess (coarseness) over the range of from a low image density region to a high image density region.

A still another object of the present invention is to provide a black toner which enables formation of high-quality black images having neither reddishness nor bluishness.

A further object of the present invention is to provide a black toner which has the same transfer performance as toners with different colors, has a superior glossiness and enables stable formation of full-color images with a high resolution, even in a color image forming apparatus.

That is, the present invention provides a black toner comprising at least a binder resin and an iron-titanium composite oxide;

the iron-titanium composite oxide being a colorant and contained in an amount of from 20 to 70 parts by mass based on 100 parts by mass of the binder resin;

the black toner having a weight average particle diameter (D4) of from 3.0 to 9.0 μm and a saturation magnetization of 2.0 $Am^2/kg$ or less;

the black toner having, in X-ray diffraction thereof, a maximum peak at 2θ=from 32.5 to 33.1 degrees; the maximum peak having a half width of 0.25 degree or less; and the black toner having, in a proportion of less than 30% by number, an iron-titanium composite oxide having, in a sectional photograph of the toner, a maximum frequency of linearity within the range where the linearity is smaller than 2.4 and having a linearity of 3.0 or more, in regard to the number frequency distribution of the linearity of the iron-titanium composite oxide, expressed by the following expression:

$$\text{Linearity}=\{(\text{absolute maximum length of iron-titanium composite oxide})^2/\text{area of iron-titanium composite oxide}\}\times\pi/4$$

BEST MODE FOR CARRYING OUT THE INVENTION

Figure 1:
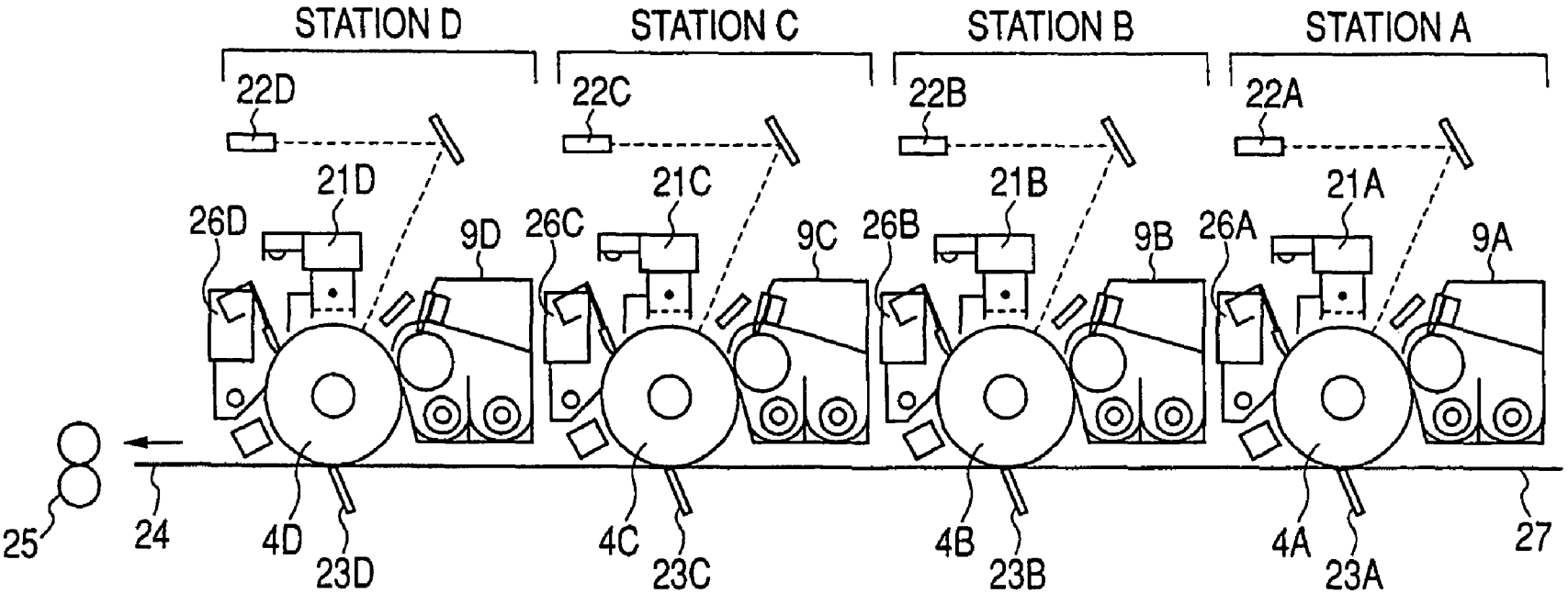
FIG. 1 is a schematic view of the construction of a full-color image forming apparatus in which the black toner of the present invention can be used.

As a result of extensive studies, the present inventors have discovered that, where a iron-titanium composite oxide is used as a colorant, the particle diameter factor and state of dispersion in toner of the iron-titanium composite oxide may be controlled, whereby a toner can be obtained which can well bring out the colorant properties such as coloring power and blackness of the iron-titanium composite oxide and at the same time has well been improved in performance also in respect of the performance relating to electrophotography, such as developing, transfer and fixing.

In the present invention, the black toner has a weight average particle diameter (D4) of from 3.0 to 9.0 μm, more preferably from 3.0 to 7.0 μm, and particularly preferably from 4.0 to 6.5 μm. The toner having such particle diameter has superior fine-line reproducibility of images, coloring power and so forth. In general, small-diameter toners have superior fine-line reproducibility of images, coloring power and so forth, but on the other hand tend to cause white-background fog, charge-up during running, and so forth. Especially where the colorant stand dispersed non-uniformly, the problems as stated above have tended to arise. However, the black toner of the present invention has enabled resolution of these problems.

The black toner of the present invention has a saturation magnetization of 2.0 $Am^2/kg$ or less, preferably 1.5 $\mu m^2/kg$ or less, and more preferably 1.0 $\mu m^2/kg$ or less. Especially where the black toner is blended with a carrier and used as a two-component developer, and if it has a saturation magnetization of more than 2.0 $\mu m^2/kg$, some toner having come liberated from the carrier comes to stagnate on the developer carrying member (a developing roller or a developing sleeve) of a developing assembly. In such a case, a phenomenon called "take-around" may occur, in which the toner continues to always exist on the developer carrying member without being used in the development whatever it proceeds in cycles. Once such take-around occurs, it comes about that the toner exists on the developer carrying member in a large quantity, and hence the exchange of electric charges between the developer carrying member and the carrier becomes insufficient to inevitably cause a lowering of charge quantity of the toner. As the result, the action on the toner by the aid of an electric field in the development region becomes small to tend to cause a lowering of development efficiency and faulty images such as ghost.

The iron-titanium composite oxide according to the present invention may preferably have a coefficient of variation [=(particle diameter standard deviation σ/number average primary particle diameter)×100] of 45% or less. Any iron-titanium composite oxide that may have a coefficient of variation of more than 45% is considered to have many sintered portions due to heat treatment, and makes it difficult to achieve the desired blackness. Also, where it is used in non-magnetic toners, it may come poorly dispersed in the resin to make it difficult to achieve the desired image density. It may preferably have a coefficient of variation of 40% or less. The iron-titanium composite oxide according to the present invention may also preferably have a particle diameter standard deviation a of from 0.01 to 0.18 μm.

Where the iron-titanium composite oxide is used as the colorant, the state of dispersion of the oxide in the toner may be controlled to obtain a toner having a sufficient blackness.

Further, it is preferable that, in the observation of a sectional photograph of the black toner, and in regard to an iron-titanium composite oxide having a circle-equivalent diameter of 0.1 μm or more, a maximum frequency of the linearity of the iron-titanium composite oxide is present within the region where the linearity is smaller than 2.4 on the basis of number; the linearity being shown by the following expression. It is more preferable that the maximum frequency is present within the range of from 1.4 to 2.0. Incidentally, in regard to the measurement of the linearity, the linearity as agglomerates is measured where the iron-titanium composite oxide is present in toner in an agglomerated state.

$$\text{Linearity}=\{(\text{absolute maximum length of iron-titanium composite oxide})^2/\text{area of iron-titanium composite oxide}\}\times\pi/4$$

In regard to the linearity, it is further preferable that the colorant having a linearity of 3.0 or more is present in an amount of less than 30% by number, and more preferably less than 20% by number.

In the present invention, it has been found that the controlling of the linearity as described above brings improvements in not only color characteristics such as density and blackness in the black toner but also properties required therein from the viewpoint of the process of image formation.

In the black toner of the present invention, the iron-titanium composite oxide may be dispersed in toner as primary particles. However, if the iron-titanium composite oxide is present as primary particles in its greater part, the color tint at halftone areas tends to come reddish. Hence, the iron-titanium composite oxide may preferably be present as agglomerates in such an extent that its dispersed-particle diameter observed on the sectional photograph is more than 0.3 μm and 1.2 μm or less. The dispersed-particle diameter may more preferably be from 0.35 to 1.0 μm, and still more preferably from 0.4 to 0.9 μm.

In the black toner of the present invention, if the maximum frequency of the linearity of the iron-titanium composite oxide is more than 2.4, the toner may have a low density, and the iron-titanium composite oxide may come dispersed insufficiently, and, especially where halftone images are fixed at a low temperature, the toner may be inhibited from penetrating into paper to tend to cause faulty fixing such as low-temperature offset and toner come-off.

If an iron-titanium composite oxide having a linearity of 3.0 or more is in a content of 30% by number or more, conducting paths may be formed in the toner to cause a lowering of transfer performance, even if the iron-titanium composite oxide according to the present invention, having a higher resistivity than carbon black, is used. As the result, problems in images tend to arise, such as a lowering of character or letter reproducibility due to a decrease in transfer efficiency.

In order to satisfy the linearity, it is necessary to relatedly control the particle shape and particle size distribution of the iron-titanium composite oxide and the state of its dispersion in toner. In pulverization toners, in order to control the linearity the iron-titanium composite oxide shows, it may be controlled by controlling the viscosity and kneading temperature of the binder resin. It is effective, e.g., to use two types of resins which differ in viscoelasticity and knead them at a low temperature. It has also found effective in regard to the controlling of the linearity, to add fine resin particles or fine inorganic powder to the binder resin and knead them together with the iron-titanium composite oxide. It is considered that such fine particles or fine powder act(s) as a filler to enable control of the linearity.

Meanwhile, it is important to use, as the iron-titanium composite oxide, one having a uniform particle diameter and not being easily causative of agglomeration when the toner is produced. As to the iron-titanium composite oxide, it is possible to obtain particles with uniform particle diameter without forming any agglomerates, by setting a lower temperature at the time of heating and firing. However, where particles (e.g., magnetite particles) serving as base particles are formed and thereafter fired with addition of titanium oxide, unreacted matter of titanium oxide and so forth at the time of firing tends to remain in the particles if the temperature is set lower at the time of heating and firing. Accordingly, it is more preferable to carry out the firing by using particles incorporated beforehand therein with Ti atoms, and this enables less formation of the unreacted matter while obtaining the particles with uniform particle diameter.

The black toner of the present invention may preferably have, in its X-ray diffraction, a maximum peak at 2θ=from 32.5 to 33.1 degrees, and the maximum peak has a half width of 0.25 degree or less, more preferably 0.23 degree or less, and still more preferably 0.20 degree or less. Incidentally, what is meant by "having a maximum peak at 2θ=from 32.5 to 33.1 degrees" is that the peak top of the maximum peak is present within this range. Such peak characteristics in X-ray diffraction are due to the iron-titanium composite oxide, and can be achieved by controlling the crystal system of the iron-titanium composite oxide and the state of dispersion of the iron-titanium composite oxide in toner.

In regard to the (104) plane that affords the maximum peak in X-ray diffraction, hematite ($Fe_2O_3$) shows a peak at 2θ=from 33.1 to 33.2 degrees, and the diffraction angle in X-ray diffraction shifts to a narrow-angle side with progress of substitution of Fe atoms with Ti atoms. Having the maximum peak at 2θ=from 32.5 to 33.1 degrees is considered to mean that the crystal structure contains an $FeTiO_3$—$Fe_2O_3$ solid solution as a chief component, and has come into the iron-titanium composite oxide. This compound has a corundum structure wherein Fe atoms of the trigonal structure hematite ($Fe_2O_3$) have been substituted with Ti atoms in part. Where the half width of this maximum peak is more than 0.25 degree, it is considered that the titanium stands non-uniformly present in the iron-titanium composite oxide. In such a case, the iron-titanium composite oxide tends to come non-uniformly dispersed in the toner particles. Hence, it tends to result that no sufficient image density is achieved and also toner properties such as fixing performance and transfer performance come inferior.

The iron titanium composite oxide is also constituted of polycrystals. The half width of the maximum peak comes larger as each crystallite is smaller. If the crystallite is small, the toner tends to take on a reddish tint, making it unable to obtain a black toner having a good black color. Also, if the crystallite is small, the resistivity at the interfaces between crystals lowers to make it difficult to obtain an iron titanium composite oxide having a sufficient resistivity. Hence, where such an iron titanium composite oxide is incorporated in the toner particles, the toner may have a low charging performance to tend to make images recognized as non uniform images. In particular, where the black toner is used in combination with color toners to form full color images, especially the image non uniformity may remarkably occur.

That is, the black toner of the present invention having the characteristic feature of X-ray diffraction as described above is one in which the iron-titanium composite oxide is dispersed in the toner particles in an almost uniform state and also the iron-titanium composite oxide contained is formed of large crystallites.

The iron-titanium composite oxide may preferably have an average primary particle diameter (D1) of from 0.10 to 0.30 μm, and more preferably from 0.15 to 0.25 μm.

If the iron-titanium composite oxide has too large primary particle diameter, it is difficult to achieve a sufficient coloring power, and also the iron-titanium composite oxide tends to come to come off the toner particle surfaces to tend to cause contamination of various members. If on the other hand it has too small primary particle diameter, the toner has a strongly reddish tint, making it difficult for the toner to take on a black color with a good quality.

The iron-titanium composite oxide according to the present invention may preferably have a saturation magnetization of 5.0 $\mu m^2/kg$ or less, and more preferably 3.0 $\mu m^2/kg$ or less. If it has a saturation magnetization of more than 5.0 $\mu m^2/kg$, it is difficult to make adaptation to a system making use of any existing non-magnetic toner, so that any desired image density may be achieved with difficulty. Also, the toner taking around on the developer carrying member may increase, and hence toner having an insufficient charge quantity may increase as a result of running to bring about a high possibility of fogging. Also, the use of the iron-titanium composite oxide having the saturation magnetization as specified above makes it easy to achieve the saturation magnetization required as the toner.

The iron-titanium composite oxide according to the present invention may preferably have a BET specific surface area of from 3.0 to 15.0 $m^2/g$ as measured utilizing nitrogen adsorption. If it has a BET specific surface area of less than 3.0 $m^2/g$, it has so coarse particles as to provide a low coloring power. If it has a BET specific surface area of more than 15.0 $m^2/g$, it is difficult to achieve the desired blackness. It may more preferably have a BET specific surface area of from 6.0 to 12.0 $m^2/g$, and still more preferably from 6.5 to 11.0 $m^2/g$.

In the iron-titanium composite oxide according to the present invention, it is preferable that the ratio of specific surface area measured by utilizing steam adsorption ($S_{H2O}$) to specific surface area measured by utilizing nitrogen adsorption ($S_{N2}$), $S_{H2O}/S_{N2}$ is from 0.75 to 1.25.

If the ratio $S_{H2O}/S_{N2}$ is less than 0.75, hydroxyl groups on particle surfaces are in a small quantity.

If on the other hand the ratio $S_{H2O}/S_{N2}$ is more than 1.25, hydroxyl groups on particle surfaces are present in a larger quantity than is necessary. Hence, when used in the black toner, the iron-titanium composite oxide may be poorly dispersible in the binder resin, so that no desired coloring power is achievable. This ratio $S_{H2O}/S_{N2}$ may preferably be from 0.85 to 1.15.

The iron-titanium composite oxide according to the present invention may preferably, have a steam adsorption level per unit area ($V_{0.6}-V_{0.3}$), of 0.3 $mg/m^2$ or less in the range of a relative pressure of from 0.30 to 0.60. If the toner is produced using an iron-titanium composite oxide having a steam adsorption level of more than 0.3 $mg/m^2$, the toner may consequently have poor charge characteristics in a high-temperature and high-humidity environment, which is undesirable.

Incidentally, the steam adsorption level per unit area ($V_{0.6}-V_{0.3}$), of the iron-titanium composite oxide is the value found from the difference between steam adsorption level at a relative pressure of 0.30 and that at a relative pressure of 0.60, in a steam adsorption isothermal line measured above.

The iron-titanium composite oxide according to the present invention may preferably have a titanium content of from 10 to 38 atom % based on the iron element. If it has a titanium content of less than 10 atom %, it is difficult to obtain particle powder having the desired blackness. If it has a titanium content of more than 38 atom %, it is difficult to obtain a colorant with a high density.

The iron-titanium composite oxide according to the present invention may preferably have a specific surface area ($S_{H2O}$) of from 2.25 to 18.75 $m^2/g$ as measured by utilizing steam adsorption.

As a constitutional phase of the iron-titanium composite oxide according to the present invention, it may be an $FeTiO_3$—$Fe_2O_3$ solid solution. It may also be a mixture of two or more of the $FeTiO_3$—$Fe_2O_3$ solid solution and a compound such as $Fe_2TiO_5$, an $Fe_2TiO_4$—$Fe_3O_4$ solid solution, $FeTiO_3$ or $FeTiO_4$. A spinel iron oxide such as the raw material $Fe_2O_3$ or $\gamma$-$Fe_2O_3$ may also be contained. However, in order to reduce the magnetization of the colorant, it is better to lessen the level of presence of materials other than the $FeTiO_3$—$Fe_2O_3$ solid solution as far as possible.

The iron-titanium composite oxide according to the present invention may preferably have a lightness (L*) of from 35 to 44. If it has a lightness of more than 44, it is difficult to achieve a sufficient image density when the iron-titanium composite oxide is used as the colorant and used in the black toner. As for an iron-titanium composite oxide having a lightness of less than 35, it is difficult to produce it in an industrial scale. The iron-titanium composite oxide may more preferably have a lightness of from 35 to 43.

The lightness of the iron-titanium composite oxide is measured in the following way.

0.5 g of a sample, 0.5 ml of castor oil and 1.5 g of titanium dioxide are kneaded into a paste by means of Hoover muller. To this paste, 4.5 g of clear lacquer is added, followed by kneading to be made into a coating material, which is then coated on cast-coated paper by using a 150 μm (6 mil) applicator to prepare a coated piece (coating film thickness: about 30 μm). On this coated piece, colorimetry is made using a spectral color type color guide (BYK, manufactured by Gardner GmbH) to determine the lightness (value L*) according to what is prescribed in JIS Z-8729.

The iron-titanium composite oxide according to the present invention may preferably be contained in an amount of from 20 to 70 parts by mass, and more preferably from 25 to 60 parts by mass, based on 100 parts by mass of the binder resin. If it is less than 20 parts by mass, the hiding power required as the toner may be insufficient to tend to give an insufficient image density. If it is more than 70 parts by mass, superiority may be achievable in regard to the density and blackness required as the toner, but the toner may have a low fixing performance and also result in a low transfer performance, to cause image non-uniformity and coarse images.

Incidentally, the iron-titanium composite oxide according to the present invention may contain, besides the iron and the titanium, at least one element selected from Na, Mg, Al, Si, P, Mn, Co, Ni, Cu and Zn in an amount of from 0 to 10 atom % based on the total amount of the iron and the titanium.

The black toner of the present invention may be obtained by a pulverization process in which various raw materials (e.g., a binder resin, the iron-titanium composite oxide a release agent, a charge control agent and so forth) are mixed and melt-kneaded, thereafter the kneaded product is pulverized by impingement pulverization or mechanical impact force, and subsequently the pulverized product is optionally classified by air classification to obtain a toner having the desired particle diameter. Alternatively, the toner may also be produced by a suspension polymerization process, an emulsion granulation process or the like.

In the present invention, the binder resin may preferably contain a "polyester unit". The "polyester unit" indicates a moiety having a polyester structure. The resin containing such a unit may include polyester resin and hybrid resin. Incidentally, the hybrid resin is a resin formed by chemical combination of a polyester unit with a vinyl resin unit. As a polyester monomer which constitutes the polyester unit, usable as raw-material monomers are a polyhydric alcohol and carboxylic acid components such as a polybasic carboxylic acid, a polybasic carboxylic anhydride and a carboxylic ester having two or more carboxyl groups.

Stated specifically, as a dihydric alcohol component for example, it may include bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene (2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As the carboxylic acid component, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; and unsaturated dicarboxylic acids such as fumaric acid, maleic acid and citraconic acid, or anhydrides thereof.

In particular, a polyester unit having as an alcohol component a bisphenol derivative represented by the following general formula (1) and as an acid component a dibasic or higher carboxylic acid or an acid anhydride thereof (e.g., fumaric acid, maleic acid, maleic anhydride, phthalic acid, terephthalic acid, trimellitic acid or pyromellitic acid), and obtained by polycondensation of these is preferred because it affords good charge characteristics as color toners.

(1)

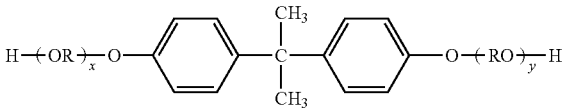

wherein R represents an ethylene group or a propylene group, or may be a mixture of an ethylene group and a propylene group, x and y are each an integer of 1 or more, and the average value of x+y is 2 to 10.

As a tribasic or higher, polycarboxylic acid component for forming a polyester unit having cross-linked moieties, it may include, e.g., 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides or ester compounds of these. The tribasic or higher, polycarboxylic acid component may preferably be used in an amount of from 0.1 to 1.9 mol % based on the whole monomers.

In the present invention, the binder resin may preferably comprise (a) the polyester resin, (b) the hybrid resin having a polyester unit and a vinyl polymer unit or (c) a mixture of these.

Where the hybrid resin in the present invention is formed, it is preferable that monomers used when the vinyl polymer unit and/or the polyester unit is/are formed is beforehand incorporated therein with a monomer component capable of reacting with components of both the resin units. Among monomers constituting the polyester resin unit, a monomer capable of reacting with the vinyl polymer unit may include, e.g., unsaturated dicarboxylic acids such as fumaric acid, maleic acid, citraconic acid and itaconic acid, or anhydrides thereof. Among monomers constituting the vinyl polymer unit, a monomer capable of reacting with components of the polyester unit may include monomers having a carboxyl group or a hydroxyl group, and acrylates or methacrylates.

As methods for obtaining the hybrid resin, which is the reaction product of the vinyl polymer unit with the polyester resin unit, preferred are i) a method in which it is obtained by using, when the vinyl resin unit is produced, a monomer capable of reacting with the polyester unit, and forming the polyester unit in the presence of the vinyl resin unit obtained, and ii) a method in which it is obtained by using, when the polyester unit is produced, a monomer capable of reacting with the vinyl resin unit, and forming the vinyl resin unit in the presence of the polyester unit obtained.

As a polymerization initiator used when the vinyl resin used in the present invention is produced, it may include; e.g., azo compounds such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexanecarbonitrile), 2-(carbamoylazo)-isobutyrohitrile, 2,2'-azobis(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and other types such as 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)

benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate and di-t-butyl peroxyazelate.

As methods by which preferred binder resins used in the toner of the present invention can be produced may include, e.g., production methods shown in the following (1) to (5).

(1) A method of separately producing a vinyl polymer and a polyester resin, and thereafter dissolving and swelling them in a small amount of an organic solvent, followed by addition of an esterifying catalyst and an alcohol and then heating to effect ester interchange reaction. The ester compound thus synthesized may be used as the hybrid resin component.

(2) A method of first producing a vinyl resin unit and thereafter producing a polyester unit and a hybrid resin component in the presence of the vinyl resin unit. The hybrid resin component is produced by allowing the vinyl resin unit (a vinyl monomer may optionally be added) to react with a polyester monomer (such as an alcohol or a carboxylic acid) and/or a polyester. In this case, too, an organic solvent may appropriately be used.

(3) A method of first producing a polyester unit and thereafter producing a vinyl polymer unit and a hybrid resin component in the presence of the polyester unit. The hybrid resin component is produced by allowing the polyester unit (a polyester monomer may optionally be added) to react with a vinyl monomer and/or a vinyl polymer unit.

(4) A vinyl polymer unit and a polyester unit are first produced and thereafter a vinyl monomer and/or a polyester monomer (such as an alcohol or a carboxylic acid) is/are added in the presence of these polymer units to produce a hybrid resin component. In this case, too, an organic solvent may appropriately be used.

(5) A vinyl monomer and a polyester monomer (such as an alcohol or a carboxylic acid) are mixed to effect addition polymerization and polycondensation reaction continuously to produce a vinyl polymer unit, a polyester unit and a hybrid resin component. An organic solvent may further appropriately be used.

In the above production processes (1) to (5), a plurality of polymer units having different molecular weights and different degrees of cross-linking may be used as the vinyl polymer unit and/or the polyester unit.

The black toner of the present invention may be incorporated with a release agent. The release agent usable may include, e.g., aliphatic hydrocarbon waxes such as low-molecular weight polyethylene, low-molecular weight polypropylene, low-molecular weight olefin copolymer, microcrystalline wax, paraffin wax and Fischer-Tropsch wax; oxides of aliphatic hydrocarbon waxes, such as polyethylene oxide wax; waxes composed chiefly of a fatty ester, such as aliphatic hydrocarbon waxes; and those obtained by subjecting part or the whole of fatty esters to deoxidation, such as deoxidized carnauba wax. It may further include partially esterified products of fatty acids with polyhydric alcohols, such as monoglyceride behenate; and methyl-esterified compounds having a hydroxyl group, obtained by hydrogenation of vegetable fats and oils. Waxes particularly preferably usable are aliphatic hydrocarbon waxes such as paraffin wax, polyethylene wax and Fischer-Tropsch wax, as having short molecular chains and also having less steric hindrance and a superior mobility.

The release agent may preferably have, in the endothermic curve in the measurement by differential scanning calorimetry, one or two or more endothermic peaks in the range of temperature of from 30° C. to 200° C. and, in the endothermic peaks, a maximum endothermic peak temperature of from 60° C. to 110° C., and more preferably from 60° C. to 90° C. If it has a peak temperature lower than 60° C., the toner tends to have poor anti-blocking properties. If on the other hand it has a peak temperature of more than 110° C., the toner may have a low releasability at low temperature to tend to have poor low-temperature fixing performance, making it necessary to apply a high pressure in a fixing assembly in order to perform fixing at a low temperature.

The release agent used in the present invention may preferably be in a content of from 1 to 10 parts by mass, and more preferably from 2 to 8 parts by mass, based on 100 parts by mass of the binder resin. If it is in a content of less than 1 part by mass, it may come about that the releasability is not well brought out at the time of oil less fixing and that the low-temperature fixing properties become deteriorated. If it is in a content of more than 10 parts by mass, the release agent tends to exude to toner surfaces, and may tend to cause blank areas on fixed images.

In producing the toner by the pulverization process, the release agent may be added as a release agent dispersed master batch.

As the release agent dispersed master batch, it may preferably be one having at least (i) a polyester resin, (ii) a hydrocarbon wax, and (iii) a graft copolymer of a polyolefin with a polymer synthesized using at least one monomer selected from the group consisting of a styrene monomer, an acrylic acid monomer and a methacrylic acid monomer.

In the black toner of the present invention, a known charge control agent may also be used in combination. Such a charge control agent may include, e.g., organic metal complexes, organic metal salts and chelate compounds, which may more specifically include monoazo metal complexes, acetylacetone metal complexes, hydroxycarboxylic acid metal complexes, polycarboxylic acid metal complexes, and polyol metal complexes. Besides, the charge control agent may also include carboxylic acid derivatives such as carboxylic acid metal salts, carboxylic anhydrides and carboxylic esters, and condensation products of aromatic compounds. As the charge control agent, also usable are phenolic derivatives such as bisphenols and carixarene.

As the charge control agent used in the present invention, it may preferably be an aromatic carboxylic acid derivative selected from aromatic oxycarboxylic acids and aromatic alkoxycarboxylic, acids, or a metal compound of the aromatic carboxylic acid derivative. As metals thereof, divalent or more metal atoms are preferred. As divalent metal atoms, they may include $Mg2^+$, $Ca2^+$, $Sr2^+$, $Pb2^+$, $Fe_2^+$, $Co2^+$, $Ni2^+$, $Zn2^+$ and $Cu2^+$. As divalent metal atoms, $Zn2^+$, $Ca2^+$, $Mg2^+$ and $Sr2^+$ are preferred. As trivalent or more metal atoms, they may include $Al3^+$, $Cr3^+$, $Fe_3^+$ and $Ni3^+$. Of these metals, preferred are $Al3^+$ and $Cr3^+$, and particularly preferred is $Al3^+$.

In the present invention, an aluminum compound of 3,5-di-tert-butylsalicylic acid is particularly preferred as the charge control agent.

In the present invention, the charge control agent may be in a content of from 0.1 to 10 parts by mass, and more preferably from 0.2 to 5 parts by mass, based on 100 parts by mass of the binder resin. If it is in a content of less than 0.1 part by mass, the toner may greatly change in charge quantity in environments of from high-temperature and high-humidity environment to low-temperature and low-humidity environment. If it is in a content of more than 10 parts by mass, the toner may have a poor low-temperature fixing performance.

The black toner of the present invention may preferably be used as a black toner used when full-color images are formed. As colorants for color toners used in combination with the black toner, known pigments and dyes may be used alone or in combination. For example, the dyes may include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6.

In use as toners for full-color image formation, color pigments for magenta toner may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. Pigment Violet 19; and C.I. Vat Red 1, 2, 10, 13, 15, 23, 29, 35.

Such pigments may be used alone. In view of image quality of full-color images, it is more preferable to use the dye and the pigment in combination so that the color sharpness can be improved. As dyes for magenta, they may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

As color pigments for cyan, they may include C.I. Pigment Blue 2, 3, 15, 16, 17; C.I. Acid Blue 6; C.I. Acid Blue 45; and copper phthalocyanine pigments the phthalocyanine skeleton of which has been substituted with 1 to 5-phthalimide methyl group(s). Particularly preferably used is C.I. Pigment Blue 15:3.

As color pigments for yellow, they may include C.I. Pigment Yellow 1, 2, 3, 4, 5, 6, 7, 10, 11, 12, 13, 14, 15, 16, 17, 23, 65, 73, 74, 83, 93, 97, 155, 180, 185; and C.I., Vat Yellow 1, 3, 20.

The colorants used in color toners may each preferably be used in an amount of from 1 to 15 parts by mass, more preferably from 3 to 12 parts by mass, and still more preferably from 4 to 10 parts by mass, based on 100 parts by mass of the binder resin. If the colorant is in a content of more than 15 parts by mass, the transparency may lower, and, in addition, the reproducibility of halftone as typified by flesh color of humans also tends to lower. Moreover, the toner may be low stable in chargeability and also may achieve low-temperature fixing performance with difficulty. If the colorant is in a content of less than 1 part by mass, the toner may have a low coloring power, and must be used in a large quantity in order to secure image density, tending to damage dot reproducibility and making it difficult to obtain high-grade images with high image density.

For the purpose of improving fluidity and transfer performance, in particular, toner release from the carrier or photosensitive member and keep blank areas from occurring, fine particles may preferably be used in its external addition. As external additives added externally to the surfaces of toner, one of them may be inorganic fine particles and may at least be one or more of fine titanium oxide particles, fine alumina particles and fine silica particles, and the inorganic fine particles may have a peak value in number distribution, of from 80 nm or more to 200 nm or less. This is preferable in order to make the inorganic fine particles function as spacer particles for improving the toner release from carrier. Also, as the external additives, fine particles having a peak value in number distribution, of 50 nm or less may preferably be used in combination. This is preferable in order to improve the fluidity of the toner.

In the case when the black toner of the present invention is used in the two-component developer, a magnetic carrier as shown below may be used. As the magnetic carrier, it may include particles of, e.g., metals such as surface-oxidized or unoxidized iron, nickel, copper, zinc, cobalt, manganese, chromium and rare earth elements, magnetic alloys or magnetic oxides thereof, and magnetic ferrite. Further usable is a binder type carrier comprising a resin and a magnetic powder dispersed therein.

In the present invention, it is preferable to use a coated carrier obtained by using the above carrier as carrier cores and coating the surfaces of the carrier cores with a coat material.

In the coated carrier, as methods for coating the carrier cores surfaces with a coat material, applicable are a method in which a coat material dissolved or suspended in a solvent is coated to make it adhere to the carrier cores, and a method in which a coat material and the carrier cores are merely mixed in the form of powder.

The coat material with which the carrier cores are to be coated may include polytetrafluoroethylene, monochlorotrifluoroethylene polymer, polyvinylidene fluoride, silicone resins, polyester resins, styrene resins, acrylic resins, polyamide, polyvinyl butyral, and aminoacrylate resins. Any of these may be used alone or in plurality.

The amount of treatment with the coat material may appropriately be determined. It is preferable to make treatment in such a way that the coat material is in an amount of from 0.1 to 30% by mass, and more preferably from 0.5 to 20% by mass, in the coated carrier.

The carrier may preferably have a 50% volume average particle diameter of from 10 to 80 μm, and more preferably from 20 to 70 μm.

If the carrier has a 50% volume average particle diameter of less than 10 μm, the two-component developer may strongly pack, and the toner and the carrier may come low blendable to make it difficult for the toner to be stably chargeable and further tend to cause adhesion of the carrier to the photosensitive drum surface.

If the carrier has a 50% volume average particle diameter of more than 80 μm, the opportunities of contact with the toner may decrease, so that toner with a low charge quantity may come present together to tend to cause fog. Further, since the toner tends to scatter, the toner concentration in the two-component developer must be set a little lower, and this may make it unable to form images with a high image density.

Further preferred is a magnetic carrier containing 70% by mass or more of carrier particles of 250 mesh-pass (mesh opening: 62 μm) and 400 mesh-on (mesh opening: 36 μm) and having the 50% volume average particle diameter of from 10 to 80 μm.

As a particularly preferred carrier, it is a carrier obtained by treating the surfaces of carrier core particles such as magnetic ferrite core particles with a coat material such as a silicone resin, a fluorine resin, a styrene resin, an acrylic resin or a methacrylic resin. The treatment made here may preferably be in an amount of from 0.01 to 5 parts by mass, and more preferably from 0.1 to 1 part by mass, based on 100 parts by mass of the carrier core particles.

As a method for controlling the magnetic carrier so as to have the above 50% volume average particle diameter and a specific particle size distribution, it may be done, e.g., by classification making use of a sieve. In particular, in order to carry out the classification in a good precision, it is preferable to carry out sieving repeatedly several times, using a sieve having a suitable mesh opening. It is also an effective means to use a sieve the shape of mesh openings of which has been controlled by plating or the like.

In the two-component developer, the toner may be used in a toner concentration of from 4% by mass to 12% by mass. This is preferable in view of impartment of charge quantity, prevention of fog, securement of image density and prevention of blank areas.

An image forming method making use of the black toner of the present invention is described next with reference to the drawing.

FIG. 1 is a schematic view of the construction of a full-color copying machine which is an image forming apparatus practicing the present invention.

In what is shown in FIG. 1, stations A, B, C and D form yellow images, magenta images, cyan images and black images, respectively, of full-color images.

The color order of the stations does not matter at all. In the following description, where a primary charging assembly 21 for example is noted, it refers to primary charging assemblies 21A, 21B, 21C and 21D of the stations A, B, C and D, respectively. In the respective stations, images are formed in the following way.

First, an image bearing member photosensitive drum 4 is rotatably provided. The photosensitive drum 4 is uniformly electrostatically charged by means of a primary charging assembly 21, and next exposed correspondingly to information signals by means of a light-emitting device 22 such as a laser to form electrostatic latent images, which are then made into visible images by means of a developing assembly 9. Next, the visible images are transferred to a transfer sheet 24 by the aid of a transfer charging assembly 23; the transfer sheet 24 having been transported by means of a transfer sheet transport belt 27.

The transfer sheet 24 passes through the respective stations, so that a yellow toner image, a magenta toner image, a cyan toner image and a black toner image are superimposingly transferred thereto.

The transfer sheet 24 to which these toner images of four colors have been superimposed is sent to a fixing assembly 25, where the toner images are fixed, and is then put out of the apparatus as a full-color image-formed material. Also, the toner having remained on the photosensitive drum without being transferred at the time of transfer is removed by a cleaning means 26.

How to measure physical properties concerning the present invention is described below.

—Number Average Particle Diameter (D1) and Particle Diameter Standard Deviation σ of Iron-Titanium Composite Oxide—

Measured on arbitrary 350 particles by using a statistic analyzer (DIGITIZER KD4620, manufactured by Graphtec Corporation), in respect of an image (20,000 magnifications) of particles photographed by electron microscopic observation, and their number average particle diameter (D1) and particle diameter standard deviation σ are determined.

Particle diameter variation coefficient (%) is also calculated from the above number average particle diameter D1 (μm) and particle diameter standard deviation σ (μm) and according to the following expression. It expresses that, the smaller the value of the variation coefficient is, the sharper the particle size distribution is.

$$\text{Particle diameter variation coefficient (\%)}=(\sigma/D1)\times 100.$$

—Determination of Toner by X-Ray Diffraction—

The determination of the black toner of the present invention by X-ray diffraction is made under the following conditions.

Analyzer: Full-automatic X-ray diffraction analyzer RINT-TTRII, manufactured by Rigaku International Corporation.
X-ray tube: Cu.
Tube voltage: 50 kV.
Tube current: 300 mA.
Scanning mode: Continuous.
Scanning rate: 4 deg./min.
Sampling interval: 0.020 deg.
Start angle (2θ): 3 deg.
Stop angle (2θ): 60 deg.
Divergence slit: Open.
Divergence vertical limitation slit: 10.00 mm
Scatter slit: Open.
Receiving slit: Open.
A curved monochromator is used.

Incidentally, in measuring the half width of a specific peak, in order to improve measurement precision, changes are made on the following items to make measurement.

Scanning mode: FT mode.
Counting time: 1.0 sec.
Sampling interval: 0.005 deg.
Start angle (2θ): 32 deg.
Stop angle (2θ): 34 deg.

—Ti Atom Content of Iron-Titanium Composite Oxide—

To measure the content of Ti atoms based on Fe atoms, a calibration curve is first prepared using a sample for the calibration curve, and the amount of the measuring sample to be added is calculated from the calibration curve. Stated in detail, the sample for the calibration curve is put into a fluorescent X-ray analyzer RIX-211 Model (manufactured by Rigaku International Corporation), and the X-ray intensity is measured. This measurement is repeated on a plurality of samples (e.g., 5 samples with ratios of Ti/Fe of 0, 0.1, 0.2, 0.3 and 0.4) different in concentration to prepare the calibration curve. Next, X-ray intensity of each measuring sample is measured to determine the content of Ti atoms on the basis of the calibration curve. Incidentally, the fluorescent X-ray analysis is made according to JIS K 0119, fluorescent X-ray analysis general rules.

Incidentally, where a kneaded product of the iron-titanium composite oxide and a resin is used as the sample, the sample is press-molded by using a sample press molding machine MAEKAWA Testing Machine (manufactured by MFG Co., Ltd.). Where the iron-titanium composite oxide is used as the sample, the iron-titanium composite oxide and a resin are mixed, and the sample is press-molded by using the sample press molding machine. The press-molding is performed by applying a pressure of 196,000 kPa (2,000 kg/cm$^2$) to about 4 g of the sample for about 30 seconds to prepare a measurement specimen with a thickness of 2 mm and a diameter of about 39 mm.

—BET Specific Surface Area of Iron-Titanium Composite Oxide—

The specific surface area measured by utilizing nitrogen adsorption, ($S_{N2}$) is determined by the BET multi-point method by $N_2$ adsorption, using MONO SORB MS-II (manufactured by Yuasa Ionics Co.). As pretreatment of a sample, the sample is deaerated at 50° C. for 10 hours.

The specific surface area measured by utilizing steam adsorption ($S_{H2O}$) is the value measured by the BET method in the range of a relative pressure of from 0.05 to 0.30, by using a steam adsorption instrument BELSORP 18 (manufactured by Bel Japan, Inc.), subjecting the iron-titanium composite oxide to deaeration treatment at 120° C. for 2 hours, and measuring the steam adsorption isothermal line at an adsorption temperature of 25° C. Incidentally, the steam adsorption level $V_{0.3}$ or $V_{0.6}$ in a case in which the relative pressure is 0.30 or 0.60 is also measured at the adsorption temperature of 25° C. by using the above instrument.

—Measurement of Weight Average Particle Diameter (D4) of Toner Particles (Toner Particles Before External Addition) and Toner—

COULTER COUNTER TA II or COULTER MULTISIZER II (manufactured by Coulter Electronics, Inc.) is used as a measuring instrument. As an electrolytic solution, an aqueous solution of about 1% NaCl is used. An electrolytic solution prepared using first-grade sodium chloride, e.g., ISOTON R II (registered trademark; available from Coulter Scientific Japan Co.) may be used as the electrolytic solution.

As a method of measurement, as a dispersant 0.1 to 5 ml of a surface active agent (preferably an alkylbenzenesulfonate) is added to 100 to 150 ml of the above aqueous electrolytic solution, and further 2 to 20 mg of a sample for measurement is added. The electrolytic solution in which the sample has been suspended is subjected to dispersion for about 1 minute to about 3 minutes in an ultrasonic dispersion machine. The volume distribution and number distribution of the sample are calculated by measuring the volume and number of the sample for each channel by means of the above measuring instrument, using an aperture of 100 μm as its aperture. Then the weight-average particle diameter (D4) of the sample is determined from these distributions. As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

—Measurement of Magnetization of Iron-Titanium Composite Oxide and Toner—

The intensity of magnetization of the iron-titanium composite oxide and that of the toner are determined from magnetic properties and true specific gravity. The magnetic properties of the iron-titanium composite oxide and toner may be measured with Vibration Sample Type Magnetism Meter VSM 3S-15 (manufactured by Toei Industry Co., Ltd.). As a method for measurement, a cylindrical plastic container is filled with a sample (the iron-titanium composite oxide or the toner) in a well dense state, and this is placed in an external magnetic field of 10 kOe (796 kA/m). In this state, the magnetic moment of the sample filled in the container is measured. Further, the actual mass of the sample filled in the container is measured to determine the intensity of magnetization ($Am^2/kg$) of the iron-titanium composite oxide and toner.

—How to Measure Endothermic Peak of Wax—

Measured according to ASTM D3418-82, using a differential scanning calorimeter (DSC measuring instrument) DSC-7, manufactured by Perkin-Elmer Corporation. A sample for measurement is precisely weighed in an amount of 2 to 10 mg, preferably 5 mg. This sample is put in an aluminum pan and an empty aluminum pan is used as reference. Measurement is made in a normal-temperature and normal-humidity environment (23° C./60% RH) at a heating rate of 10° C./min within the measuring temperature range of from 30 to 200° C. In the course of this heating, endothermic peaks of a DSC curve are found in the temperature range of from 30 to 200° C.

—Measurement of Linearity of Iron-titanium Composite Oxide in Toner—

The toner is dispersed in a water soluble resin, TISSUE-TEK O.C.T. Compound(Sakura Finetechnical Co., Ltd.). Using liquid nitrogen, the water soluble resin is frozen in an atmosphere with a preset temperature of −80° C. in an equipment, a cryomicrotome ULTRACUT N FC4E (manufactured by Reichert, Inc.). Thereafter, the frozen resin is trimmed with a glass knife to have a cut shape of about 0.1 mm in width and about 0.2 mm in length. Next, using a diamond knife, an ultrathin section (slice) (thickness setting: 70 nm) of toner containing the water soluble resin is prepared, and this is moved onto a grid mesh for TEM observation by using an eyelash probe. After the atmosphere was returned to room temperature, the water-soluble resin is dissolved in pure water to obtain a sample for TEM observation.

Using an electron microscope H-7500 (manufactured by Hitachi Ltd.), this sample for TEM observation is photographed at an accelerating voltage of 100 kV. The magnification is 5,000 to 10,000 times.

The image information obtained is read at 600 dpi through an interface, introduced into an image analyzer Win ROOF Version 5.0 (manufactured by Microsoft Corporation-Mitani Corporation), and then converted into binary image data. Of the data, iron-titanium composite oxide particles of 0.1 μm or more in circle-equivalent diameter are analyzed at random, where the measurement is repeated until the number of sampling exceeds 100 times, and the linearity of each particle is determined according the following expression. Incidentally, in regard to the measurement of the linearity, the linearity as agglomerates is measured where the iron-titanium composite oxide is present in toner particles in an agglomerate state. Further, the distribution of this linearity is taken as frequency distribution ranging from 1.0 to 5.0 at intervals of 0.2, and the range of its maximum frequency is determined. Also, as to the amount of presence of the iron-titanium composite oxide having a linearity of 3.0 or more, frequency distribution of 3.0 or more in linearity is determined with respect to the whole range of the linearity.

$$\text{Linearity}=\{(\text{absolute maximum length of iron-titanium composite oxide})^2/\text{area of iron-titanium composite oxide}\}\times\pi/4.$$

The dispersed-particle diameter (or dispersed-agglomerate diameter) of the iron-titanium composite oxide in the toner is also calculated as circle-equivalent diameter on the basis of the image data used in measuring the linearity.

EXAMPLES

Working examples are given below. The present invention is by no means limited to these working examples.

Iron-type Black Particle

Production Example 1

To 22.2 liters of an aqueous 2.76 mol/liter NaOH solution, 17.8 liters of an aqueous 1.8 mol/liter ferrous sulfate solution was added to obtain a reaction solution containing an iron hydroxide salt colloid, in a total volume of 40.0 liters and with pH 6.5. Thereafter, this reaction solution was heated to 90° C. The reaction solution heated was aerated for 100 minutes and at the same time 18.0 liters of an aqueous 0.48 mol/liter titanyl sulfate solution was added to form a black precipitate. During this operation, the system was kept at a temperature of 90° C. and at pH 6.5.

This black precipitate was filtered and then washed with water, followed by drying at 60° C., and this was further heated and fired at 730° C. for 60 minutes in a stream of $N_2$ gas, followed by pulverization treatment to obtain an iron-titanium composite oxide as a black particle powder.

The black particle powder obtained had a number average primary particle diameter (D1) of 0.17 μm, a standard deviation σ of 0.059 μm, a coefficient of variation [=(σ/D1)×100] of 34.7%, a BET specific surface area of 9.9 $m^2/g$ as measured utilizing nitrogen adsorption, a saturation magnetization σs of 0.3 $\mu m^2/kg$, and a titanium content of 26.8 atom % based on the total iron. Its constitutional phase was an $FeTiO_3$—$Fe_2O_3$ solid solution. This is designated as Black Colorant 1.

Iron-type Black Particle

Production Example 2

To 22.2 liters of an aqueous 2.76 mol/liter NaOH solution, 17.8 liters of an aqueous 1.8 mol/liter ferrous sulfate solution was added to obtain a reaction solution containing an iron salt hydroxide colloid, in a total volume of 40.0 liters and with pH 6.5. Thereafter, this reaction solution was heated to 90° C. The reaction solution heated was aerated for 100 minutes and at the same time 3.3 liters of an aqueous 0.48 mol/liter titanyl sulfate solution was added to form a black precipitate. During this operation, the system was kept at a particularly of 90° C. and at pH 6.5.

To an aqueous suspension containing this black precipitate, 16.7 liters of an aqueous titanyl sulfate solution was added to obtain a black precipitate the particle surfaces of which were covered with titanium.

This black precipitate was filtered and then washed with water, followed by drying at 60° C., and this was further heated and fired at 790° C. for 60 minutes in a stream of $N_2$ gas, followed by pulverization treatment to obtain an iron-titanium composite oxide. Its constitutional phase was a mixture of an $FeTiO_3$—$Fe_2O_3$ solid solution and $Fe_3O_4$-$\gamma Fe_2O_3$. This is designated as Black Colorant 2. Physical properties of Black Colorant 2 are shown in Table 1.

Iron-type Black Particle

Production Example 3

To an aqueous suspension containing 10 kg of spherical magnetite particle powder, an aqueous solution containing 43.6 mols of titanyl sulfate (corresponding to 30 atom % in terms of Ti based on the total Fe of the magnetite-particle powder) was added. Incidentally, at the time of its addition, NaOH was added to the liquid mixture formed, so as to keep the pH of the reaction solution at 8.5 or more. Next, the pH of the liquid mixture was adjusted to 8.0 and a hydrous oxide of titanium was allowed to deposit on the particle surfaces of magnetite particles, followed by filtration, washing with water and then drying to obtain a black spherical magnetic iron oxide particle powder the particle surfaces of which were covered with the hydrous oxide of titanium.

100 g of the black spherical magnetic iron oxide particle powder the particle surfaces of which were covered with the hydrous oxide of titanium was heated and fired at 790° C. for 120 minutes in a stream of $N_2$ gas, followed by pulverization treatment to obtain an iron-titanium composite oxide. Its constitutional phase was a mixture of an $FeTiO_3$—$Fe_2O_3$ solid solution and $Fe_3O_4$-$\gamma Fe_2O_3$. This is designated as Black Colorant 3. Physical properties of Black Colorant 3 are shown in Table 1.

Iron-type Black Particle

Production Example 4

An iron-titanium composite oxide was obtained in the same manner as in Iron-type Black Particle Production Example 3 except that the heating and firing conditions were changed to 730° C. for 60 minutes. Its constitutional phase was a mixture of an $FeTiO_3$—$Fe_2O_3$ solid solution and $Fe_3O_4$-$\gamma Fe_2O_3$. This is designated as Black Colorant 4. Physical properties of Black Colorant 4 are shown in Table 1.

Iron-type Black Particle

Production Example 5

An iron-titanium composite oxide was obtained in the same manner as in Iron-type Black Particle Production Example 3 except that the heating and firing conditions were changed to 840° C. for 120 minutes. Its constitutional phase was a mixture of an $FeTiO_3$—$Fe_2O_3$ solid solution and $Fe_3O_4$-$\gamma Fe_2O_3$. This is designated as Black Colorant 5. Physical properties of Black Colorant 5 are shown in Table 1.

Iron-type Black Particle

Production Example 6

A black precipitate was formed under the same conditions as those in Iron-type Black Particle Production Example 1 except that the amount in which the aqueous 0.48 mol/liter titanyl sulfate solution was added was changed to 20 liters, and the pH of the system to 9.5. This black precipitate was filtered and then washed with water, followed by drying at 60° C., and this was further heated and fired at 730° C. for 60 minutes in a stream of $N_2$ gas, followed by pulverization treatment to obtain an iron-titanium composite oxide. Its constitutional phase was an $FeTiO_3$—$Fe_2O_3$ solid solution. This is designated as Black Colorant 6. Physical properties of Black Colorant 6 are shown in Table 1.

Iron-type Black Particle

Production Example 7

A black precipitate was formed under the same conditions as those in Iron-type Black Particle Production Example 1 except that an aqueous titanium tetrachloride solution was used in place of the aqueous titanyl sulfate solution and the titanium treatment level was halved. This black precipitate was filtered and then washed with water, followed by drying at 60° C., and this was further heated and fired at 820° C. for 120 minutes in a stream of $N_2$ gas, followed by pulverization treatment to obtain an iron-titanium composite oxide. Its constitutional phase was a mixture of an $FeTiO_3$—$Fe_2O_3$ solid solution and $Fe_3O_4$-$\gamma Fe_2O_3$. This is designated as Black Colorant 7. Physical properties of Black Colorant 7 are shown in Table 1.

Iron-Type Black Particle

Production Example 8

In Iron-type Black Particle Production Example 2, the aqueous titanyl sulfate solutions were changed for aqueous titanyl tetrachloride solutions. The first-time titanyl tetrachloride solution was so added as to be in an amount of 3.2 mols in terms of titanium tetrachloride, and the second-time titanyl tetrachloride solution was so added as to be in an amount of 8 mols in terms of titanium tetrachloride. Under the same conditions as those in Iron-type Black Particle Production Example 2 except for the foregoing, a black precipitate was formed the particle surfaces of which were covered with titanium.

This black precipitate was filtered and then washed with water, followed by drying at 60° C., and this was further heated and fired at 770° C. for 60 minutes in a stream of $N_2$ gas, followed by pulverization treatment to obtain an iron-titanium composite oxide. Its constitutional phase was an $FeTiO_3$—$Fe_2O_3$ solid solution. This is designated as Black Colorant 8. Physical properties of Black Colorant 8 are shown in Table 1.

Iron-Type Black Particle

Production Example 9

A black precipitate the particle surfaces of which were covered with titanium was formed under the same conditions as those in Iron-type Black Particle Production Example 2 except that the amount of the first-time titanyl sulfate solution added was changed to 10 liters, and the amount of the second-time titanyl sulfate solution to 10 liters.

This black precipitate was filtered and then washed with water, followed by drying at 60° C., and this was further heated and fired at 740° C. for 60 minutes in a stream of $N_2$ gas, followed by pulverization treatment to obtain an iron-titanium composite oxide. Its constitutional phase was an $FeTiO_3$—$Fe_2O_3$ solid solution. This is designated as Black Colorant 9. Physical properties of Black Colorant 9 are shown in Table 1.

TABLE 1

| Black colorant: | Saturation magnetization ($Am^2/kg$) | Number average primary particle diameter (μm) | BET specific surface area $S_{N2}$ ($m^2/g$) | Specific surface-area $S_{H2O}$ measured by steam adsorption ($m^2/g$) | $V_{0.6}$-$V_{0.3}$ ($mg/m^2$) | Ti/ total Fe (atm %) | Standard deviation (μm) | Coefficient of variation (%) |
|---|---|---|---|---|---|---|---|---|
| 1 | 0.3 | 0.17 | 9.9 | 9.8 | 0.18 | 26.8 | 0.059 | 34.7 |
| 2 | 4.7 | 0.31 | 5.2 | 4.3 | 0.22 | 29.9 | 0.132 | 42.6 |
| 3 | 3.2 | 0.19 | 9.8 | 15.2 | 0.33 | 29.6 | 0.090 | 47.3 |
| 4 | 14.3 | 0.15 | 10.3 | 10.8 | 0.25 | 29.8 | 0.072 | 48.0 |
| 5 | 2.9 | 0.12 | 13.2 | 18.3 | 0.36 | 29.7 | 0.064 | 53.0 |
| 6 | 1.2 | 0.11 | 12.8 | 11.9 | 0.19 | 29.7 | 0.041 | 37.3 |
| 7 | 3.8 | 0.26 | 6.4 | 5.7 | 0.14 | 14.9 | 0.108 | 41.5 |
| 8 | 0.3 | 0.24 | 6.8 | 6.3 | 0.24 | 34.6 | 0.091 | 37.9 |
| 9 | 2.1 | 0.19 | 9.4 | 9.2 | 0.20 | 29.9 | 0.064 | 33.7 |

Hybrid Resin Production Example 1

As vinyl copolymer materials, 1.9 mols of styrene, 0.21 mol of 2-ethylhexyl acrylate, 0.15 mol of fumaric acid, 0.03 mol of a dimer of α-methylstyrene and 0.05 mol of dicumyl peroxide were put into a dropping funnel. Also, as polyester unit materials, 7.0 mols of polyoxypropylene(2.2)-2,2-bis(4-hydroxyphenyl)propane, 3.0 mols of polyoxyethylene(2.2)-2,2-bis(4-hydroxyphenyl)propane, 3.0 mols of succinic acid, 2.0 mols of trimellitic anhydride, 5.0 mols of fumaric acid and 0.2 g of dibutyltin oxide were put into a 4-liter four-necked flask made of glass, and a thermometer, a stirring rod, a condenser and a nitrogen feed tube were attached thereto. This four-necked flask was placed in a mantle heater. Next, the inside atmosphere of the four-necked flask was displaced with nitrogen gas, followed by gradual heating with stirring. With stirring at a temperature of 145° C., the vinyl monomers and polymerization initiator were dropwise added from the above dropping funnel over a period of 4 hours. Subsequently, the mixture was heated to 200° C. to carry out reaction for about 4 hours to obtain Hybrid Resin (1).

Polyester Resin Production Example 1

3.6 mols of polyoxypropylene(2.2)-2,2-bis(4-hydroxyphenyl)propane, 1.4 mols of polyoxyethylene(2.2)-2,2-bis(4-hydroxyphenyl)propane, 3.0 mols of terephthalic acid, 0.2 mol of trimellitic anhydride, 1.7 mols of fumaric acid and 0.1 g of dibutyltin oxide were put into a 4-liter four-necked flask made of glass, and a thermometer, a stirring rod, a condenser and a nitrogen feed tube were attached thereto. In an atmosphere of nitrogen, the reaction was carried out at 215° C. for 5 hours to obtain Polyester Resin (1).

Polyester Resin Production Example 2

With monomer constitution of 1.6 mols of polyoxypropylene(2.2)-2,2-bis(4-hydroxyphenyl)propane, 3.4 mols of polyoxyethylene(2.2)-2,2-bis(4-hydroxyphenyl)propane, 2.0 mols of terephthalic acid, 0.2 mol of trimellitic anhydride and 2.7 mols of fumaric acid, the reaction was carried out in the same manner as the above to obtain Polyester Resin (2).

Carrier Production Example

To magnetite powder of 0.25 μm in number average particle diameter, 4.0% by mass of a silane coupling agent 3-(2-aminoethylaminopropyl)trimethoxysilane was added, and these were mixed and stirred at a high speed in a container at 100° C. or more to make lipophilic treatment of the magnetite powder. Hematite powder of 0.60 μm in number average particle diameter was also subjected to lipophilic treatment in the same way.

| | (by mass) |
|---|---|
| Phenol | 10 parts |
| Formaldehyde solution (formaldehyde: 40%; methanol: 10%; water: 50%) | 6 parts |
| Lipophilic-treated magnetite | 63 parts |
| Lipophilic-treated hematite | 21 parts |

The above materials and 5 parts by mass of 28% ammonia water and 10 parts by mass of water were put into a flask, and, with stirring and mixing, these were heated to 85° C. over a period of 30 minutes and held thereat to carry out polymerization reaction for 3 hours to effect curing. Thereafter, the reaction system was cooled to 30° C., and water was further added thereto. Thereafter, the supernatant liquid was removed, and then the precipitate was washed with water, followed by air drying. Subsequently, this was dried at a temperature of 60° C. under reduced pressure (5 mmHg or less) to obtain spherical magnetic resin particles (carrier cores) with both magnetite and hematite standing dispersed therein.

A copolymer of methyl methacrylate and methyl methacrylate having a perfluoroalkyl group (the number of carbon: 7, that is, $—(CF_2)_6—CF_3$) (copolymerization ratio: 8:1; weight average molecular weight: 45,000) was used as a coating resin. Further, based on 100 parts by mass of the coating resin, 10 parts by mass of melamine particles (number average particle diameter: 290 nm) and 6 parts by mass of carbon particles (resistivity: $1\times10^{-2}$ Ωcm; number average particle diameter: 30 nm) were mixed. The mixture thus obtained was added to a mixed solution of methyl ethyl ketone and toluene (1:10) so as to be in a solid matter concentration of 10% by mass, and then these were dispersed for 30 minutes by means of an ultrasonic dispersion machine to prepare a coating fluid.

With continuous application of shear stress to this coating fluid, the solvents were evaporated off at 70° C., and the magnetic resin particle surfaces were so resin-coated that the coating resin content came to 2.5 parts by mass based on 100 parts by mass of the magnetic resin particles. The magnetic carrier particles thus resin-coated were heat-treated with stirring at 10° C. for 2 hours, followed by cooling, and thereafter disintegration, and further followed by classification using a 200 mesh (mesh opening: 75 μm) sieve to obtain a carrier having a 50% volume particle diameter of 33 μm, a true specific gravity of 3.53 g/cm$^3$, an apparent specific gravity of 1.84 g/cm$^3$ and a magnetization intensity of 42 Am$^2$/kg under a magnetic field of 79.6 kA/m.

Example 1

A black toner (Black Toner 1) was prepared in the following way.

| | (by mass) |
|---|---|
| Hybrid Resin (1) | 80 parts |
| Polyester Resin (1) | 20 parts |
| Black Colorant 1 | 30 parts |
| Wax A (paraffin wax; DSC endothermic main peak: 68° C.) | 5 parts |
| Aluminum compound of 3,5-di-tert-butylsalicylic acid (charge control agent) | 1 part |

The above materials were well mixed using HENSCHEL mixer (FM-75 Type, manufactured by Mitsui Miike Engineering Corporation). Thereafter, the mixture obtained was kneaded by means of a twin-screw kneader (PCM-45 Type, manufactured by Ikegai Corp.) set to a temperature of 140° C. The kneaded product obtained was cooled, and then crushed by means of a hammer mill to a size of 1 mm or less to obtain a crushed product for toner. The crushed product obtained was finely pulverized by means of an impact air grinding machine making use of a high-pressure gas. The finely pulverized product obtained had a weight average particle diameter (D4) of 4.8 μm. Next, the finely pulverized product obtained was classified by means of a multi-division classifier to simultaneously strictly remove fine powder and coarse powder, to obtain a black classified product.

To 100 parts by mass of the black classified product obtained, 1.0 part by mass of titanium oxide particles having been hydrophobic-treated and having a peak value in number distribution, of 40 nm and 1.5 parts by mass of amorphous silica having a peak value in number distribution, of 110 nm were externally added and these were mixed to obtain a black toner (Black Toner 1). Black Toner 1 thus obtained had a weight average particle diameter (D4) of 5.5 μm and a number average particle diameter (D1) of 4.9. μm and a 8 parts by mass of Black Toner 1 and 92 parts by mass of Magnetic Carrier 1 were blended by means of Turbla mixer to make up Black Developer 1.

Using this Black Developer 1, images were formed by reversal development, using an altered machine of a full-color copying machine CLC-5000, manufactured by CANON INC., having construction like that shown in FIG. 1, and the electrophotographic performance of the black toner was evaluated. The formulation of Black Toner 1 is shown in Table 2, physical properties thereof in Table 3, and test results thereon in Table 4. In regard to detailed evaluation methods, they are described later.

Example 2

Black Toner 2 was prepared in the same manner as in Example 1 except that, in place of Black Colorant 1 used in Example 1, Black Colorant 2 was used and this was added in an amount changed to 45 parts by mass. The formulation of Black Toner 2, physical properties thereof and test results thereon are shown in Tables 2 to 4.

Examples 3 and 4

Black Toners 3 and 4 were prepared in the same manner as in Example 1 except that Black Colorant 1 used in Example 1 was added in amounts changed to the amounts shown in Table 2. The formulation of Black Toners 3 and 4, physical properties thereof and test results thereon are shown in Tables 2 to 4.

Example 5

Black Toner 5 was prepared in the following way.

| | (by mass) |
|---|---|
| Hybrid Resin (1) | 80 parts |
| Polyester Resin (1) | 20 parts |
| Black Colorant 3 | 30 parts |
| Wax A (paraffin wax; DSC endothermic main peak: 68° C.) | 5 parts |
| Aluminum compound of 3,5-di-tert-butylsalicylic acid (charge control agent) | 1 part |
| Silica A (amorphous silica having a peak value in number distribution, of 110 nm) | 10 parts |

The above materials were well mixed using HENSCHEL mixer (FM-75 Type, manufactured by Mitsui Miike Engineering Corporation). Thereafter, the mixture obtained was kneaded by means of a twin screw-kneader (PCM-45 Type, manufactured by Ikegai Corp.) set to a temperature of 110° C. The kneaded product obtained was cooled, and then crushed by means of a hammer mill to a size of 1 mm or less to obtain a crushed product.

On this crushed product, fine pulverization, classification and external addition were carried out in the same manner as in Example 1 to prepare Black Toner 5. The formulation of Black Toner 5, physical properties thereof and test results thereon are shown in Tables 2 to 4.

Comparative Example 1

Black Toner 6 was prepared in the same manner as in Example 1 except that, in place of Black Colorant 1 used in Example 1, Black Colorant 4 was used. The formulation of Black Toner 6, physical properties thereof and test results thereon are shown in Tables 2 to 4.

Comparative Example 2

Black Toner 7 was prepared in the following way.

| | (by mass) |
|---|---|
| Polyester Resin (1) | 100 parts |
| Black Colorant 3 | 30 parts |
| Wax A (paraffin wax; DSC endothermic main peak: 68° C.) | 5 parts |
| Aluminum compound of 3,5-di-tert-butylsalicylic acid (charge control agent) | 1 part |

The above materials were well mixed using HENSCHEL mixer (FM 75 Type, manufactured by Mitsui Miike Engineering Corporation). Thereafter, the mixture obtained was kneaded by means of a twin-screw kneader (PCM-45 Type, manufactured by Ikegai Corp.) set to a temperature of 140° C. The kneaded product obtained was cooled, and then crushed by means of a hammer mill to a size of 1 mm or less to obtain a primary crushed product.

This primary crushed product was further kneaded by means of a twin-screw kneader (PCM-45 Type, manufactured by Ikegai Corp.) set to a temperature of 140° C. The kneaded product obtained was crushed by means of a hammer mill to a size of 1 mm or less to obtain a secondary crushed product.

On this secondary crushed product, fine pulverization, classification and external addition were carried out in the same manner as in Example 1 to prepare Black Toner 7. The formulation of Black Toner 7, physical properties thereof and test results thereon are shown in Tables 2 to 4.

Comparative Example 3

Black Toner 8 was prepared in the following way.

| | (by mass) |
|---|---|
| Polyester Resin (1) | 100 parts |
| Black Colorant 3 | 30 parts |
| Wax A (paraffin wax; DSC endothermic main peak: 68° C.) | 5 parts |
| Aluminum compound of 3,5-di-tert-butylsalicylic acid (charge control agent) | 1 part |
| Silica A (amorphous silica having a peak value in number distribution, of 110 nm) | 5 parts |

The above materials were well mixed using HENSCHEL mixer (FM-75 Type, manufactured by Mitsui Miike Engineering Corporation). Thereafter, the mixture obtained was kneaded by means of a twin screw-kneader (PCM-45 Type, manufactured by Ikegai Corp.) set to a temperature of 140° C. The kneaded product obtained was cooled, and then crushed by means of a hammer mill to a size of 1 mm or less to obtain a crushed product.

On this crushed product, fine pulverization, classification and external addition and mixing were carried out in the same manner as in Example 1 to prepare Black Toner 8. The formulation of Black Toner 8, physical properties thereof and test results thereon are shown in Tables 2 to 4.

Comparative Example 4

Black Toner 9 was prepared in the same manner as in Example 1 except that, in place of Black Colorant 1 used in Example 1, Black Colorant 5 was used. The formulation of Black Toner 9, physical properties thereof and test results thereon are shown in Tables 2 to 4.

Comparative Example 5

The crushed product made up in Example 1 was finely pulverized by means of the impact air grinding machine at a different pressure of the high-pressure gas. Next, the finely pulverized product obtained was classified by means of a multi-division classifier to simultaneously strictly remove fine powder and coarse powder, to obtain a black classified product having a weight average particle diameter of 9.5 μm. To this black classified product, titanium oxide and amorphous silica were externally added in the same manner as in Example 1 to obtain Black Toner 10. The formulation of Black Toner 10, physical properties thereof and test results thereon are shown in Tables 2 to 4.

Comparative Example 6

The crushed product made up in Example 1 was finely pulverized by means of the impact air grinding machine at a different pressure of the high-pressure gas. Next, the finely pulverized product obtained was classified by means of a multi-division classifier to simultaneously strictly remove fine powder and coarse powder, to obtain a black classified product having a weight average particle diameter of 2.8 μm. To this black classified product, titanium oxide and amorphous silica were externally added in the same manner as in Example 1 to obtain Black Toner 11. The formulation of Black Toner 11, physical properties thereof and test results thereon are shown in Tables 2 to 4.

Comparative Examples 7 and 8

Black Toners 12 and 13 were prepared in the same manner as in Example 1 except that Black Colorant 1 used in Example 1 was added in amounts changed to the amounts shown in Table 2. The formulation of Black Toners 12 and 13, physical properties thereof and test results thereon are shown in Tables 2 to 4.

Examples 6 and 7

Black Toners 14 and 15 were prepared in the same manner as in Example 1 except that the raw materials shown in Table 2 were used. The formulation of Black Toners 14 and 15, physical properties thereof and test results thereon are shown in Tables 2 to 4.

Incidentally, Wax B is paraffin wax having a DSC endothermic main peak at 85° C.). As fine styrene-acrylic resin particles (noted as St-Ac resin particles in the table) added internally, used are those having the mole ratio of styrene: methyl methacrylate 50:50, a number average particle diameter of 150 nm, a number average molecular weight of 12,000, a weight average molecular weight of 80,000 and a THF (tetrahydrofuran)-insoluble matter of 30% by mass.

Examples 8 to 13

Using the raw materials shown in Table 2, a kneaded products were obtained in the same way as in Example 1, and were each finely pulverized by means of the impact air grinding machine, followed by further classification by means of a multi-division classifier. Here, the pressure of the high-pressure gas of the multi-division classifier and the conditions for classification in the multi-division classifier were changed. Thus, Black Toners 16 to 21 were obtained. The formulation of Black Toners 16 to 21, physical properties thereof and test results thereon are shown in Tables 2 to 4.

Example 14

A cyan toner (Cyan Toner 1) was prepared in the following way.

First kneading step:

| | (by mass) |
|---|---|
| Hybrid Resin (1) | 60 parts |
| Pasty pigment with 40% by mass of solid content (C.I. Pigment Blue 15:3), obtained without going through any drying step at all after its synthesis (remaining 60% by mass: water) | 100 parts |

The above raw materials were introduced into a kneader type mixer, and were heated with mixing under application of no pressure. At the time the resultant mixture reached a maximum temperature (which depends necessarily on the boiling point of a solvent in the paste; in this case, about 90 to 100° C.), the pigment in aqueous phase became distributed or moved to the molten resin phase. Having made sure of this, the mixture was further melt-kneaded for 30 minutes with heating to cause the pigment in the paste to move sufficiently to the resin phase. Thereafter, the mixer was first stopped, and the hot water was discharged. Then the mixture was further heated to 130° C. and melt-kneaded for about 30 minutes with heating to disperse the resin, and at the same time the water was evaporated off. After these steps were completed, the system was cooled to take out the kneaded product to obtain a first kneaded product. This first kneaded product had a water content of about 0.5% by mass.

Second kneading step:

| | (by mass) |
|---|---|
| Hybrid Resin (1) | 92.5 parts |
| Above first kneaded product (content of pigment particles: 40% by mass) | 12.5 parts |
| Wax A (paraffin wax; DSC endothermic main peak: 68° C.) | 5 parts |
| Aluminum compound of 3,5-di-tert-butylsalicylic acid (charge control agent) | 1.0 part |

Materials formulated as shown above were well premixed using HENSCHEL mixer (FM 75-Type, manufactured by Mitsui Miike Engineering Corporation). Thereafter, the mixture obtained was kneaded by means of a twin-screw kneader (PCM-45 Type, manufactured by Ikegai Corp.) set to a temperature of 130° C. The kneaded product obtained was cooled, and then crushed by means of a hammer mill to a size of 1 mm or less to obtain a crushed product. The crushed product obtained was finely pulverized in the same way as in Example 1, using the impact air grinding machine making use of a high-pressure gas. Thereafter, the finely pulverized product obtained was classified by means of a multi-division classifier to simultaneously strictly remove fine powder and coarse powder, to obtain cyan toner particles.

To 100 parts by mass of the cyan toner particles obtained, 1.0 part by mass of titanium oxide particles having been hydrophobic-treated and having a peak value in number distribution, of 40 nm and 1.5 parts by mass of amorphous silica having a peak value in number distribution, of 110 nm were externally added and these were mixed to obtain a cyan toner. The cyan toner obtained had a weight average particle diameter of 5.5 μm.

8 parts by mass of the cyan toner and 92 parts by mass of Magnetic Carrier 1 were blended by means of TURBLA mixer to make up a cyan developer.

Next, a yellow toner and a magenta toner were prepared in the same manner as the preparation of the cyan toner except that, in place of the pasty pigment containing C.I. Pigment Blue 15:3, a pasty pigment containing 40% by mass of C.I. Pigment Yellow 74 or C.I. Pigment Red 122 and also containing 60% by mass of water was used and was so added as to be in the content shown in Table 2. The yellow toner and magenta toner thus obtained were also blended with the like carrier to prepare a yellow developer and a magenta developer.

Using the evaluation machine used in Example 1 and using the cyan developer, the yellow developer, the magenta developer and Black Developer 1 prepared in Example 1, full-color images were formed. As the result, full-color images were obtainable which were sharp and free from image defects.

TABLE 2

| | Resin(s) | | Colorant | | Release agent | | Additive (1) | | Additive (2) | |
|---|---|---|---|---|---|---|---|---|---|---|
| | Type | Amt. | Type | Amt. | Type | Amt. | Type | Amt. | Type | Amt. |
| Black Toner: | | | | | | | | | | |
| 1 | Hybrid R.(1) | 80 | Black Col. 1 | 30 | Wax A | 5 | DTBSA Al | 1 | | |
| | Polyester R.(1) | 20 | | | | | | | | |
| 2 | Hybrid-R.(1) | 80 | Black Col. 2 | 45 | Wax A | 5 | DTBSA Al | 1 | | |
| | Polyester R.(1) | 20 | | | | | | | | |
| 3 | Hybrid R.(1) | 80 | Black Col. 1 | 65 | Wax A | 5 | DTBSA Al | 1 | | |
| | Polyester R.(1) | 20 | | | | | | | | |
| 4 | Hybrid R.(1) | 80 | Black Col. 1 | 22 | Wax A | 5 | DTBSA Al | 1 | | |
| | Polyester R.(1) | 20 | | | | | | | | |
| 5 | Hybrid R.(1) | 80 | Black Col. 3 | 30 | Wax A | 5 | DTBSA Al | 1 | Silica A | 10 |
| | Polyester R.(1) | 20 | | | | | | | | |

TABLE 2-continued

| | Resin(s) | | Colorant | | Release agent | | Additive (1) | | Additive (2) | |
|---|---|---|---|---|---|---|---|---|---|---|
| | Type | Amt. | Type | Amt. | Type | Amt. | Type | Amt. | Type | Amt. |
| 6 | Hybrid R.(1) | 80 | Black Col. 4 | 30 | Wax A | 5 | DTBSA Al | 1 | | |
| | Polyester R.(1) | 20 | | | | | | | | |
| 7 | Polyester R.(1) | 100 | Black Col. 3 | 30 | Wax A | 5 | DTBSA Al | 1 | | |
| 8 | Polyester R.(1) | 100 | Black Col. 3 | 30 | Wax A | 5 | DTBSA Al | 1 | Silica A | 5 |
| 9 | Hybrid R.(1) | 80 | Black Col. 5 | 30 | Wax A | 5 | DTBSA Al | 1 | | |
| | Polyester R.(1) | 20 | | | | | | | | |
| 10 | Hybrid R.(1) | 80 | Black Col. 1 | 30 | Wax A | 5 | DTBSA Al | 1 | | |
| | Polyester R.(1) | 20 | | | | | | | | |
| 11 | Hybrid R.(1) | 80 | Black Col. 1 | 30 | Wax A | 5 | DTBSA Al | 1 | | |
| | Polyester R.(1) | 20 | | | | | | | | |
| 12 | Hybrid R.(1) | 80 | Black Col. 1 | 80 | Wax A | 5 | DTBSA Al | 1 | | |
| | Polyester R.(1) | 20 | | | | | | | | |
| 13 | Hybrid R.(1) | 80 | Black Col. 1 | 15 | Wax A | 5 | DTBSA Al | 1 | | |
| | Polyester R.(1) | 20 | | | | | | | | |
| 14 | Hybrid R.(1) | 100 | Black Col. 1 | 30 | Wax B | 5 | DTBSA Al | 1 | Silica A | 10 |
| 15 | Hybrid R.(1) | 100 | Black Col. 1 | 30 | Wax B | 5 | DTBSA Al | 1 | St-Ac RP | 5 |
| 16 | Polyester R.(1) | 100 | Black Col. 1 | 30 | Wax B | 5 | DTBSA Al | 1 | St-Ac RP | 5 |
| 17 | Polyester R.(1) | 100 | Black Col. 1 | 30 | Wax B | 5 | DTBSA Al | 1 | St-Ac RP | 5 |
| 18 | Polyester R.(2) | 100 | Black Col. 6 | 45 | Wax C | 4.5 | DTBSA Al | 0.5 | St-Ac RP | 5 |
| 19 | Polyester R.(2) | 100 | Black Col. 7 | 28 | Wax C | 5.5 | DTBSA Al | 0.5 | Silica A | 5 |
| 20 | Polyester R.(2) | 100 | Black Col. 8 | 35 | Wax C | 5 | DTBSA Al | 0.5 | Silica A | 5 |
| 21 | Polyester R.(2) | 100 | Black Col. 9 | 55 | Wax C | 5.5 | DTBSA Al | 0.5 | St-Ac RP | 10 |
| Cyan Toner: | | | | | | | | | | |
| 1 | Hybrid R.(1) | 100 | PB-15:3 | 5 | Wax A | 5 | DTBSA Al | 1 | | |
| Yellow Toner: | | | | | | | | | | |
| 1 | Hybrid R.(1) | 100 | PY-74 | 8 | Wax A | 5 | DTBSA Al | 1 | | |
| Magenta Toner: | | | | | | | | | | |
| 1 | Hybrid R.(1) | 100 | PR-122 | 9 | Wax A | 5 | DTBSA Al | 1 | | |

Amt.: Amount (parts by mass)
Col.: Colorant; DTBSA Al: di-tert-butylsalicylic acid aluminum compound
St-Ac RP: styrene-acrylate resin particles How to evaluate the black toner by using the image forming apparatus is described next.

A full-color copying machine CLC5000, manufactured by CANON INC., was used in the evaluation. As its laser, a 655 nm semiconductor laser was used, and its spot diameter was set smaller so as to enable output at 1,200 dpi. Also, the surface layer of a fixing roller was changed for a silicone tube, and an oil application mechanism was detached.

White-Background Fog;

The potential on a photosensitive member was so controlled that the image area density came to about 1.4 and also that the difference in potential between non-image area potential ($V_D$) and direct-current component ($V_{DC}$) of development bias applied to a developing sleeve came to 150 V ($V_{back}$). Solid white images were formed under such conditions. During the image formation, the photosensitive member was stopped, where the toner on the photosensitive member before the transfer step was taken off by using Mylar tape and this was stuck onto paper. Also, Mylar tape was stuck onto paper as it was, and this was used as reference.

In regard to measurement, DENSITOMETER TC-6DS, manufactured by Tokyo Denshoku Co., Ltd., was used to measure the reflectance (%). Its difference from the reference was regarded as the value of fog.

A: The difference in reflectance is 0.5% or less, as being good.
B: The difference in reflectance is more than 0.5% to 1.0% or less.
C: The difference in reflectance is more than 1.0%, but not distinguishable as fog images in visual observation.
D: The difference in reflectance is more than 1.0%, and fog is seen in the white background.

Evaluation of Fine-Line Reproducibility:

Using the above toner and the above altered machine, 30H images were formed, and the images formed were visually observed to make evaluation on fine-line reproducibility of the images, according to the following criteria. Incidentally, the 30H images refer to a value which indicates 256 gradations by 16-adic number, and are halftone images regarded when 00H is solid white and FFH is solid black.

A: No feeling of coarseness at all, and images are smooth.
B: Not so feeling of coarseness.
C: There is a feeling of coarseness a little.
D: There is a feeling of much coarseness.
E: There is a feeling of very much coarseness.

Fixing Performance:

Images were so formed that the toner laid on level came to 1.0 mg/cm2 in the case of solid black images (FFH). Next, under this contrast condition, halftone images (30H) were formed, and were taken out as unfixed images without being led to any fixing assembly. Meanwhile, a fixing assembly of LASER JET 4100 (manufactured by Hewlett Pachard Co.) was detached to set up a temperature controllable assembly for external fixing tests. Using this assembly, the above unfixed images were fixed onto A4 size paper, changing fixing temperature. In respect of the fixed images obtained, a cold offset test was conducted to examine whether or not the images came off by rubbing. In the rubbing, the fixed images were backward and forward rubbed ten times with Silbon paper under a load of 4.9 kPa, where the images were judged to have come off when the image density decreased by more than 10%. Evaluation was also made visually on hot offset to examine whether or not images on the previous round appeared on white background areas after one round of the fixing assembly. Incidentally, the fixing assembly was set at a paper feed speed of 100 mm/s.

A: Solid images are fixable in a temperature range broader than 40° C., and no hot offset occurs in that fixable temperature range.

B: Solid images are fixable in a temperature range of from 30 to 40° C., and no hot offset occurs in that fixable temperature range.

C: Solid images are fixable in a temperature range of from 30 to 40° C., but hot offset occurs in halftone areas in that fixable temperature range.

D: Solid images are fixable in a temperature range narrower than 30° C.

Transfer Efficiency:

The potential contrast of the photosensitive member was so controlled that the toner laid-on level on the photosensitive member came to 0.6 mg/cm$^2$, and images were formed under this condition to form unfixed images on a transfer sheet. MYLAR tape was stuck to images transferred to the transfer sheet to measure its image density (D), and transfer residual toner on the photosensitive member was taken off by using MYLAR tape and this was stuck onto paper to measure its image density ($D_R$). From these, the transfer efficiency [=D/(D+$D_R$)] of the transfer of toner onto transfer sheet was determined. The image density was measured with a densitometer X-RITE 500 Series (manufactured by X-rite, Incorporated.). Also, transfer current was changed to find a profile of the transfer efficiency with respect to the transfer current.

Next, images were formed using the cyan toner (the one prepared in Example 14) in place of the black toner. After cyan toner images were transferred onto paper, a transfer current was applied at the transfer position of black toner that was on the downstream side of the transfer position of cyan toner (the black toner is not transferred), where the quantity of toner taken off from the paper to the photosensitive member was measured, and the transfer current was shifted to take a profile (what is called are transfer profile. The profile of this re transfer of cyan toner was compared with that of the transfer efficiency of black toner.

A: Transfer current conditions are present under which the re transfer efficiency of cyan toner is within 5% (95% or more on paper) and the transfer efficiency of black toner is 95% or more.

B: Transfer current conditions are present under which the re transfer efficiency of cyan toner is within 5% (95% or more on paper) and the transfer efficiency of black toner is 93% or more to less than 95%.

C: Transfer current conditions are present under which the re transfer efficiency of cyan toner is within 5% (95% or more on paper) and the transfer efficiency of black toner is 90% or more to less than 93%.

D. Transfer current conditions are present under which the re-transfer efficiency of cyan toner is within 5% (95% or more on paper) and the transfer efficiency of black toner is less than 90%.

Image Density:

Images were so formed that the toner laid-on level came to 0.6 mg/cm$^2$, and the density of the images formed was measured. The measurement was made using a reflection densitometer X-RITE 500 Series Spectrodensitometer, manufactured by X-rite, Incorporated.

Incorporated.

Hue of Black:

Using the above altered machine, fixed images were formed on paper (Color Laser Copier Paper TKCL A4, available from CANON INC.), changing the toner laid-on level at seven levels (0.10 g/m$^2$, 0.15 g/m$^2$, 0.20 g/m$^2$, 0.25 g/m$^2$, 0.30 g/m$^2$, 0.35 g/m$^2$ and 0.40 g/m$^2$). On each fixed image, its CIE a* and b* were measured with SPECTROSCAN, manufactured by Gretag Macbeth Ag. (measuring conditions: D65, and an angle of view of 2 degrees). The a* and b* found were plotted, and a curve was drawn which connected individual points gently, and the value giving a maximum distance from starting points (a*=0, b*=0) on the curve was found. Evaluation criteria are as shown below. Incidentally, the distance from starting points is commonly represented by c*, which is called the chromaticness.

$$c^*=\{(a^*)^2+(b^*)^2\}^{1/2},$$

A: The maximum value of c* is within 5.

B: The maximum value of c* is more than 5 to 10 or less.

C: The maximum value of c* is more than 10.

Ghost after Blank Running:

The developing assembly was detached from the above altered machine, and the developer was put into it, where the developing assembly was driven by connecting a motor from the outside. Its developing roller as a developer holding member was so controlled as to be 350 mm/s in movement speed and 30 mg/cm$^2$ in developer leak level. In this state, the developing assembly was driven for 30 minutes, and thereafter this developing assembly was set in the above altered machine to form images. The ghost refers to the difference in density in the second round of sleeve between areas where black images were formed in the first round (black-image areas) and areas where they were not formed (non-image areas), of copied images on one sheet. The density difference here was evaluated by measuring the difference in reflection density. FFH images and 00H images were formed in the first round of sleeve, and thereafter halftone 30H images were reproduced in the second and further rounds. The tone of images at second-round halftone areas was examined.

A: The difference in density in halftone images is less than 0.02

B: The difference in density in halftone images is 0.02 or more to less than 0.04.

C: The difference in density in halftone-images is 0.04 or more to less than 0.06, which is recognizable as ghost.

D: The difference in density in halftone images is or more, which is clearly recognizable as ghos

TABLE 3

| | Weight average particle diameter (μm) | Saturation magnetization ($Am^2/kg$) | X-ray diffraction Peak (deg.) | X-ray diffraction Half width (deg.) | Iron-titanium composite oxide Linearity Maximum frequency | Iron-titanium composite oxide Linearity Proportion of 3.0 or more (no. %) | Iron-titanium composite oxide Dispersed = particle diameter (μm) |
|---|---|---|---|---|---|---|---|
| Black Toner 1 | 5.5 | 0.07 | 32.8 | 0.18 | 1.6-1.8 | 8 | 0.23 |
| Black Toner 2 | 5.5 | 1.40 | 33.0 | 0.19 | 1.8-2.0 | 19 | 0.42 |
| Black Toner 3 | 5.5 | 0.11 | 32.8 | 0.18 | 1.6-1.8 | 18 | 0.39 |
| Black Toner 4 | 5.5 | 0.05 | 32.8 | 0.18 | 1.6-1.8 | 6 | 0.20 |
| Black Toner 5 | 5.5 | 0.71 | 32.7 | 0.23 | 1.2-1.4 | 22 | 0.41 |
| Black Toner 6 | 5.5 | 3.15 | 32.8 | 0.21 | 1.6-1.8 | 13 | 0.52 |
| Black Toner 7 | 5.5 | 0.71 | 32.7 | 0.23 | 1.4-1.6 | 45 | 0.51 |
| Black Toner 8 | 5.5 | 0.71 | 32.7 | 0.23 | 2.6-2.8 | 23 | 0.48 |
| Black Toner 9 | 5.5 | 0.64 | 32.9 | 0.27 | 2.0-2.2 | 25 | 0.47 |
| Black Toner 10 | 9.5 | 0.06 | 32.8 | 0.18 | 1.6-1.8 | 8 | 0.23 |
| Black Toner 11 | 2.8 | 0.06 | 32.8 | 0.18 | 1.6-1.8 | 8 | 0.22 |
| Black Toner 12 | 5.5 | 0.13 | 32.8 | 0.18 | 2.2-2.4 | 32 | 0.54 |
| Black Toner 13 | 5.5 | 0.04 | 32.8 | 0.18 | 1.4-1.6 | 17 | 0.19 |
| Black Toner 14 | 5.5 | 0.06 | 32.8 | 0.18 | 1.4-1.6 | 12 | 0.21 |
| Black Toner 15 | 5.5 | 0.06 | 32.8 | 0.18 | 1.8-2.0 | 6 | 0.20 |
| Black Toner 16 | 6.7 | 0.06 | 32.8 | 0.18 | 1.6-1.8 | 8 | 0.23 |
| Black Toner 17 | 3.2 | 0.06 | 32.8 | 0.18 | 1.6-1.8 | 11 | 0.22 |
| Black Toner 18 | 4.2 | 0.36 | 32.7 | 0.18 | 1.8-2.0 | 13 | 0.13 |
| Black Toner 19 | 5.5 | 0.79 | 33.1 | 0.15 | 1.6-1.8 | 7 | 0.31 |
| Black Toner 20 | 5.5 | 0.07 | 32.9 | 0.16 | 1.6-1.8 | 9 | 0.27 |
| Black Toner 21 | 6.2 | 0.72 | 32.5 | 0.18 | 1.4-1.6 | 16 | 0.25 |

TABLE 4

| | Image density | Maximum value of c* | Transfer efficiency | Fixing performance | Fine-line reproducibility | White = background fog | Ghost after blank running of developing assembly |
|---|---|---|---|---|---|---|---|
| Example: | | | | | | | |
| 1 | 1.45 | A | A | A | A | A | A |
| 2 | 1.38 | A | A | A | A | A | B |
| 3 | 1.58 | A | B | B | A | A | A |
| 4 | 1.35 | A | B | A | B | A | A |
| 5 | 1.36 | B | B | A | A | A | A |
| Comparative Example: | | | | | | | |
| 1 | 1.32 | A | A | A | E | D | D |
| 2 | 1.42 | B | D | B | E | A | A |
| 3 | 1.32 | B | A | D | D | B | A |
| 4 | 1.47 | C | A | A | D | B | A |
| 5 | 1.43 | A | A | A | E | A | A |
| 6 | 1.46 | A | C | A | D | D | A |
| 7 | 1.61 | A | D | D | D | A | A |
| 8 | 1.25 | A | D | A | D | A | A |
| Example: | | | | | | | |
| 6 | 1.48 | A | A | A | A | A | A |
| 7 | 1.45 | A | A | A | A | A | A |
| 8 | 1.44 | A | A | A | B | A | A |
| 9 | 1.45 | A | B | A | B | B | A |
| 10 | 1.44 | A | A | A | A | A | A |
| 11 | 1.41 | A | A | A | A | A | A |
| 12 | 1.42 | A | A | A | A | A | A |
| 13 | 1.44 | A | A | A | A | A | A |

This application claims priority from Japanese Patent Application No. 2005-117739 filed Apr. 15, 2005, which is hereby incorporated by reference herein.

The invention claimed is:

1. A black toner comprising at least a binder resin and an iron-titanium composite oxide;

said iron-titanium composite oxide being a colorant and contained in an amount of from 20 parts by mass to 70 parts by mass based on 100 parts by mass of the binder resin;

said iron-titanium composite oxide consisting essentially of a mixture of a $FeTiO_3$-$Fe_2O_3$ solid solution and a $Fe_3O_4$-γ-$Fe_2O_3$ solid solution;

said iron-titanium composite oxide having a saturation magnetization of 3.8 $\mu m^2/kg$ or less;

said black toner having a weight average particle diameter D4 of from 3.0 to 9.0 um and a saturation magnetization of 2.0 $\mu m^2/kg$ or less;

said black toner having, in X-ray diffraction thereof, a maximum peak at 2θ=from 32.5 to 33.1 degrees; the maximum peak having a half width of 0.20 degree or less; and said black toner having an iron-titanium composite oxide having a maximum frequency of linearity within the range where the linearity is smaller than 2.4 and an iron-titanium composite oxide having a linearity of 3.0 or more in a proportion of less than 30% by number, in regard to the number frequency distribution of the linearity of the iron-titanium composite oxide, expressed by the following expression, in a sectional photograph of the toner: Linearity={(absolute maximum length of iron-titanium composite oxide)$^2$/area of iron-titanium composite oxide}×π/4.

2. The black toner according to claim 1, wherein the weight average particle diameter of the black toner is from 3.0 to 7.0 μm.

3. The black toner according to claim 1, wherein said iron-titanium composite oxide contains the $FeTiO_3$-$Fe_2O_3$ solid solution as a chief component.

4. The black toner according to claim 1, wherein said iron-titanium composite oxide has a number average primary particle diameter D1 of from 0.1 to 0.3 um, and has a coefficient of variation of particle diameter, of 45% or less when expressed by the following expression:

Coefficient of variation of particle diameter=(particle diameter standard deviation/number average primary particle diameter)×100.

5. The black toner according to claim 1, wherein said iron-titanium composite oxide has, in the sectional photograph thereof, the maximum frequency of linearity within the range where the linearity is from 1.4 to 2.0, in regard to the number frequency distribution of the linearity of the iron-titanium composite oxide.

6. The black toner according to claim 1, wherein the saturation magnetization of said black toner is 1.5 $Am^2/kg$ or less.

7. The black toner according to claim 1, wherein said iron-titanium composite oxide is contained in an amount of from 25 to 60 parts by mass based on 100 parts by mass of the binder resin.

8. The black toner according to claim 1, wherein said binder resin is a resin selected from the group consisting of (a) a polyester resin, (b) a hybrid resin formed by chemical combination of a polyester unit with a vinyl polymer unit and (c) a mixture of the hybrid resin and the polyester resin.

9. The black toner according to claim 1, wherein said toner further contains a release agent, and the release agent has, in the endothermic curve thereof in the measurement by differential scanning calorimetry DSC, an endothermic main peak at from 60 to 90° C.

10. The black toner according to claim 1, wherein said toner further contains an organometallic compound, and the organometallic compound is a metal compound of an aromatic carboxylic acid derivative selected from the group consisting of an aromatic oxycarboxylic acid and an aromatic alkoxycarboxylic acid.

11. The black toner according to claim 1, wherein said iron-titanium composite oxide has a dispersed particle diameter of more than 0.3 μm to 1.2 μm or less as observed in the sectional photograph of said black toner.

* * * * *